US005307093A

United States Patent [19]

Suzuki et al.

[11] Patent Number: 5,307,093

[45] Date of Patent: Apr. 26, 1994

[54] INK JET RECORDING METHOD AND APPARATUS IN WHICH THE TEMPERATURE OF AN INK JET RECORDING HEAT IS CONTROLLED

[75] Inventors: Naohisa Suzuki, Yokohama; Kazuhisa Kawakami, Kawasaki, both of Japan

[73] Assignee: Canon Kabushiki Kaisha, Tokyo, Japan

[21] Appl. No.: 744,704

[22] Filed: Aug. 13, 1991

[30] Foreign Application Priority Data

| | | | |
|---|---|---|---|
| Aug. 14, 1990 | [JP] | Japan | 2-214646 |
| Aug. 14, 1990 | [JP] | Japan | 2-214647 |
| Aug. 14, 1990 | [JP] | Japan | 2-214648 |
| Aug. 14, 1990 | [JP] | Japan | 2-214649 |

[51] Int. Cl.[5] ..... B41J 2/01; B41J 29/38; B41J 2/195

[52] U.S. Cl. ..... 346/1.1; 346/140 R; 400/54

[58] Field of Search ..... 346/1.1, 140 R, 76 PH; 400/719, 124 TC, 54

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/104 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,712,172 | 12/1987 | Kiyohara et al. | 346/1.1 |
| 4,723,129 | 2/1988 | Endo et al. | 346/1.1 |
| 4,740,796 | 4/1988 | Endo et al. | 346/1.1 |
| 4,860,034 | 8/1989 | Watanabe et al. | 346/140 R |
| 4,875,056 | 10/1989 | Ono | 346/76 PH |
| 4,912,485 | 3/1990 | Minowa | 346/76 PH |
| 4,947,194 | 8/1990 | Kyoshima | 346/140 R |

FOREIGN PATENT DOCUMENTS

| | | | |
|---|---|---|---|
| 0205243 | 12/1986 | European Pat. Off. . | |
| 0416557 | 3/1991 | European Pat. Off. . | |
| 0440489 | 8/1991 | European Pat. Off. . | |
| 54-056847 | 5/1979 | Japan . | |
| 59-123670 | 7/1984 | Japan . | |
| 59-138461 | 8/1984 | Japan . | |
| 60-071260 | 4/1985 | Japan . | |
| 0249763 | 11/1986 | Japan | 346/140 PD |
| 2107447 | 4/1990 | Japan . | |

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

An ink jet recording apparatus uses a recording head to eject ink and has a sensor for detecting the ambient temperature of the head. A heating element in the head controls the temperature of the ink, while a counter counts a print waiting period. A table for determining drive information for the heating element in accordance with an output of the temperature detecting means is also provided. A controller, responsive to this table, controls the internal heating operation effected in the print waiting period after the end and before the start of a printing operation within a predetermined period, and controls a duty heating operation effected periodically when the predetermined period is exceeded.

60 Claims, 23 Drawing Sheets

INITIAL HEAT

| WAIT TIME/RANK | 4 | 3 | 2 | 1 | 0 |
|---|---|---|---|---|---|
| 3sec | — | 0.13sec | 0.19sec | 0.25sec | 0.30sec |

FIG. 13A

PRE-HEAT

| WAIT TIME/RANK | 4 | 3 | 2 | 1 | 0 |
|---|---|---|---|---|---|
| 0 ~ 4sec | — | — | — | — | — |
| 4~10sec | — | — | — | 0.20sec | 0.20sec |

FIG. 13B

LINE HEAT (DRAFT MODE)

| PRINT TIME/RANK | 4 | 3 | 2 | 1 | 0 |
|---|---|---|---|---|---|
| 0 ~ 60sec | — | 16ms | 16ms | 24ms | 24ms |
| 60~120sec | — | 8ms | 16ms | 16ms | 24ms |
| 120 360sec | — | 8ms | 8ms | 16ms | 16ms |
| >360sec | — | — | 8ms | 8ms | 16ms |

FIG. 13C

LINE HEAT (FINE MODE)

| PRINT TIME/RANK | 4 | 3 | 2 | 1 | 0 |
|---|---|---|---|---|---|
| 0 ~ 60sec | — | 24ms | 24ms | 32ms | 48ms |
| 60~120sec | — | 16ms | 16ms | 24ms | 32ms |
| 120~360sec | — | 16ms | 16ms | 16ms | 24ms |
| >360sec | — | 8ms | 8ms | 16ms | 24ms |

FIG. 13D

DUTY HEAT

| WAIT TIME/RANK | 4 | 3 | 2 | 1 | 0 |
|---|---|---|---|---|---|
| 6sec | — | 0.13sec | 0.19sec | 0.25sec | 0.30sec |

FIG. 13E

INK JET RECORDING METHOD AND APPARATUS IN WHICH THE TEMPERATURE OF AN INK JET RECORDING HEAT IS CONTROLLED

FIELD OF THE INVENTION AND RELATED ART

The present invention relates to a recording apparatus and a recording method using the same, more particularly to an apparatus and method having an ink jet type recording head provided with a temperature maintenance heater which controls the temperature of the recording head.

Recently, the recording apparatus, particularly a recording head, of an ink jet printer is manufactured through a film forming technique or a microprocessing technique, as in a semiconductor device manufacturing, so that the cost and the size thereof is reduced. By such a recording head manufacturing process, it is possible to provide on one silicon chip electrothermal transducer elements (heaters) for generating heat to eject the ink, transistors, diodes, switching elements or the like for driving the heater and wiring among these elements.

In view of this, a recording apparatus has been provided in which both of the ink ejection heaters and the temperature maintenance heaters are formed on one chip.

Since it is now possible to manufacture small recording heads at low cost, a recording apparatus having a replaceable type recording head integrated with an ink container, has been developed. Such a small size and low cost recording apparatus can be used with a wordprocessor, an electronic typewriter, a copying machine, a facsimile machine or the like.

In such a recording apparatus or an apparatus using it as the recording means, it is one of the trends that the size and the cost are reduced. From this standpoint, it is desirable that the structure of the temperature control for the recording head using the heating and temperature maintenance heaters is simple and small in size and low in cost.

As for the control systems for the temperature control using the temperature maintenance heater, the following is known:

(1) A temperature sensor provided in a recording head and a temperature maintenance heater are used, and the heater is continuously supplied with a voltage to effect a closed loop control;

(2) A temperature sensor outside the recording head and a temperature maintenance heater are used, and the heater is continuously supplied with a voltage to effect an open-loop control; and (3) A temperature sensor outside the recording head and a temperature maintenance heater are used, and the heater is supplied with a pulsewise voltage to effect a closed loop control (U.S. patent application Ser. No. 585,924 filed on Sep. 18, 1990).

Of these systems, system (1) requires complicated and expensive heater driving systems, and in addition, the direct detection of the recording head requires the temperature sensor to sense small temperature changes, and therefore requires relatively high accuracy. System (2) also requires complicated and expensive heater driving systems.

System (3) is advantageous in that the heater driving circuit may have a relatively simple structure, and that the control operation is easy. The following gives examples of the control systems for the temperature maintenance heater (sub-heating) for the above system (3):

(1) Initial heating is carried out upon actuation of a main switch;

(2) Preheating is carried out in response to print starting instructions after a waiting period;

(3) Line heating is carried out for every line printing; and (4) Interval heating is carried out during the waiting period after completion of the printing.

The time required for the preheating is relatively long. Since the preheating is carried out prior to the movement of the carriage, the user feels that the time between the printing instruction and the actual start of the printing is long.

In order to effect the four sub-heating control operations for the head temperature controlling system (3) described above, both a printing period measuring means for measuring an integrated printing period and a waiting period measuring means for measuring the print-waiting period after the completion of the printing are required. The methods for the measurement include a method in which respective timers are provided to measure the respective times, and a method wherein one timer for producing a relatively long constant time period, a printing counter and a wait counter are used, with counters being counted up at the timing on the basis of the constant time period produced by the timer, so that the times are measured. Either case requires at least one timer.

In a wordprocessor, a typewriter or the like having an integrated recording device as described above as the printing means and having key input means, an additional timer is required exclusively for generating timing for receiving key input information.

Thus, the conventional time measuring means requires a plurality of timers which increases the cost and decreases the simplicity of the structure.

Regarding the temperature measurement, a timer is required exclusively for providing detection timing at the regular intervals. Additionally, errors are involved in the detection system and in conversion of the measurement to a temperature range signal or to a digital signal using an A/D converter or the like. An additional timer is also required to smooth and remove variation resulting in a complicated structure.

It is effective from the standpoint of simplification of the apparatus structure to use the driving source for sub-heat for temperature maintenance as another driving source as well. For example, a carriage driving source is considered which can be used during the sub-heat drive. The carriage may be moved in two modes providing different carriage movement speeds: at the lower speed, a fine mode printing is effected in one way printing, while at the higher speed, a draft printing mode is effected in bidirectional printing.

In order to increase the carriage movement speed, the output power of the driving source must be increased, which will in turn increase the torque of the carriage motor. Therefore, if the carriage driving source is used also as the sub-heat driving source, the energy generated for the sub-heat drive changes with the carriage movement speed. Conventionally, therefore, the carriage drive responsive to the mode selection and the sub-heat drive are effected by different driving sources.

SUMMARY OF THE INVENTION

Accordingly, it is a principal object of the present invention to provide an ink jet recording apparatus, method and system in which the temperature of the recording head can be controlled to be a desired temperature in a short period of time.

It is another object of the present invention to provide an ink jet recording apparatus, system and method in which the pre-heating period is eliminated, or the period is made shorter so that the quick response is accomplished from the printing instruction to the actual start of the printing.

It is a further object of the present invention to provide an ink jet recording apparatus, method and system wherein the sub-heat control can be effected at various timings with a simple structure.

It is a further object of the present invention to provide an ink jet recording apparatus, method and system wherein the timing for a key interval interruption controlled by the key timer is used as the timing for the operations of a printing time counter and a print waiting time counter, and the sub-heat control is suitably effected on the basis of the printing time and the waiting time.

It is a yet further object of the present invention to provide an ink jet recording apparatus, method and system wherein a timer for generating key input information receiving timing is used for generating temperature detection receiving timing and also for generating the timing for smoothing the detected temperature information and for classification of the temperature having the hysteresis, by which the timer structure is unified, so that a simple structure is enough to effect various controls simultaneously.

It is a yet further object of the present invention to provide an ink jet recording apparatus, method and system wherein a carriage driving source is usable as a sub-heat driving source.

It is a further object of the present invention to provide an ink jet recording apparatus, method and system wherein the carriage driving source is used also as the sub-heat driving source in which a sub-heat control table is provided for each source voltage changeable in accordance with the change of the carriage movement mode so as to control the sub-heating in response to the carriage movement mode.

According to an aspect of the present invention, there is provided an ink jet recording apparatus using a recording head for ejecting ink, comprising: temperature detecting means for detecting ambient temperature of the recording head; a heating element in said recording head to control temperature of the ink by heating the ink in the recording head; wait counter means for counting a print waiting period of the recording head; table means for determining driving information for said heating element in accordance with an output of said temperature detecting means; and control means, responsive to said table means for controlling said heating element, said control means controlling an interval heating operation effected in the print waiting period after an end of a printing operation and before start of the printing operation within a predetermined period after the end of the printing operation, and controlling a duty heating operation effected periodically when the predetermined period is exceeded.

According to another aspect of the present invention, there is provided an ink jet recording apparatus using a recording head for ejecting ink, comprising: temperature detecting means for detecting ambient temperature of the recording head; a heating element in said recording head to control temperature of the ink by heating the ink in the recording head; print counter means for counting a printing period of the recording head; wait counter means for counting a print waiting period of the recording head; table means for determining driving information for said heating element in accordance with an output of said temperature detecting means and an output of said print counter means or an output of said wait counter means; control means, responsive to said table means, for controlling said heating element; and counter control means, responsive to periodical key interval interruption signals, for effecting counting operation of said print counter means or said wait counter means.

According to a further aspect of the present invention, there is provided an ink jet recording apparatus using a recording head for ejecting ink, comprising: temperature detecting means for detecting ambient temperature of the recording head; a heating element in said recording head to control temperature of the ink by heating the ink in the recording head; print counter means for counting a printing period of the recording head; wait counter means for counting a print waiting period of the recording head; table means for determining driving information for said heating element in accordance with an output of said temperature detecting means and an output of said print counter or an output of said wait counter; control means, responsive to said table means, for controlling said heating element; key input means for inputting information to be recorded by said recording apparatus; interruption signal generating means for generating periodical key interval interruption signals for accepting input by said key input means; and counter control means, responsive to the key interval interruption signals, for effecting counting operation of said print counter means or said wait counter means.

According to a further aspect of the present invention, there is provided an ink jet recording apparatus using a recording head for ejecting ink, comprising: temperature detecting means for detecting ambient temperature of the recording head; smoothing means for smoothing plural temperatures detected by said detecting means; temperature level classifying means for classifying an output of said smoothing means in consideration of temperature hysteresis; a heating element in said recording head to control temperature of the ink by heating the ink in the recording head; table means for determining driving information for said heating element in accordance with an output of said classifying means; control means for controlling said heating element in accordance with an output of said table means; and timing control means, responsive to periodical key interval interruption signals for accepting key inputs, to determine operations of said temperature detecting means, said smoothing means and said classifying means.

According to a further aspect of the present invention, there is provided an ink jet recording apparatus using a recording head for ejecting ink, comprising: moving means for moving the recording head during a printing operation; power supply means for supplying electric power to said moving means in accordance with movement speed of said moving means; temperature detecting means for detecting ambient temperature of the recording head; a heating element in said recording head to control temperature of the ink by heating the ink in said recording head; energizing means for energizing said heating element by the electric power from said power source; wait counter means for counting a print waiting period of the recording head; table means for determining driving information for said heating element in accordance with an output of said temperature detecting means, an output of said wait counter and an output of said power source means; and control means for controlling said heating element by said energizing means in accordance with an output of said table means.

According to a further aspect of the present invention, there is provided a ink jet recording method using a recording head ejecting ink, comprising: detecting ambient temperature of the recording head; a first heating step for heating said recording head at first intervals in accordance with the temperature detected after each of recording operation of the recording head; a second heating step of heating the recording head at second intervals in accordance with the detected temperature after a predetermined period elapses after an end of the recording operation, with energy larger than that in said first heating step; and recording step of driving the recording head after said first or second heating step.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 13A, 13B, 13C, 13D and 13E show tables for setting the heating period for various sub-heat operations in the sub-heat control operation.

DESCRIPTION OF THE PREFERRED EMBODIMENTS

Referring to the accompanying drawings, the embodiments of the present invention will be described in detail.

Figure 1A:
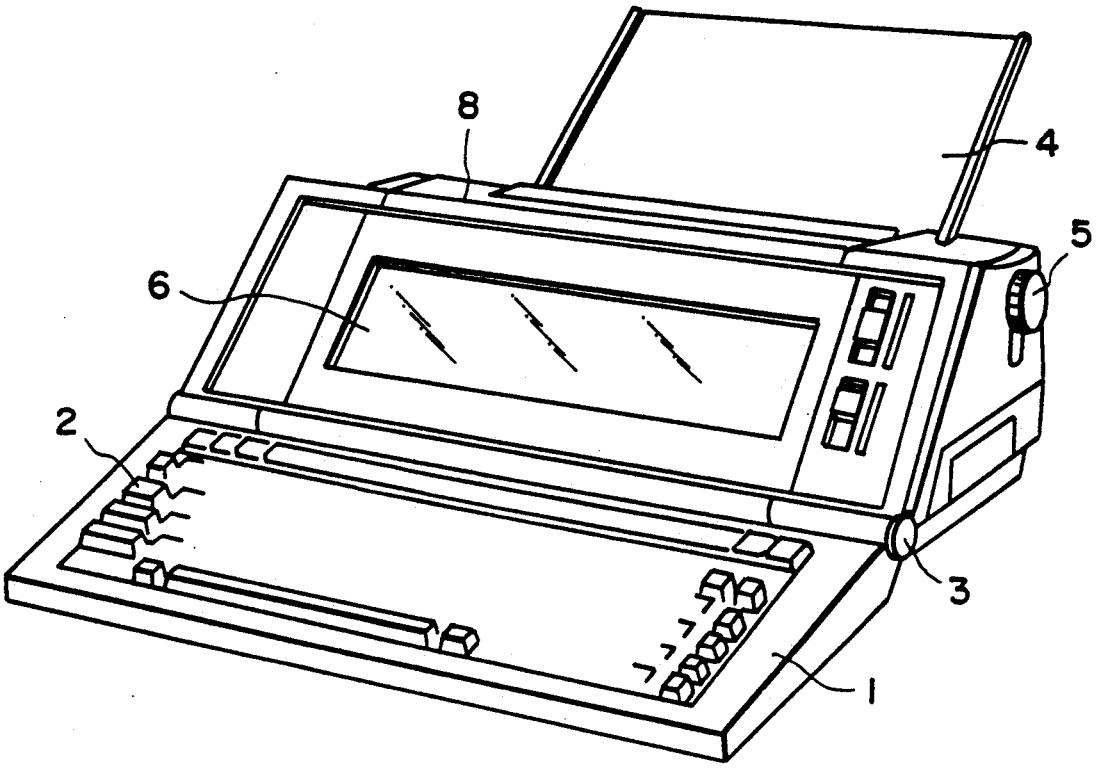
FIGS. 1A and 1B are perspective views of a recording apparatus in the form of an electronic typewriter according to an embodiment of the present invention, when it is used and when it is not used.
Figure 1B:
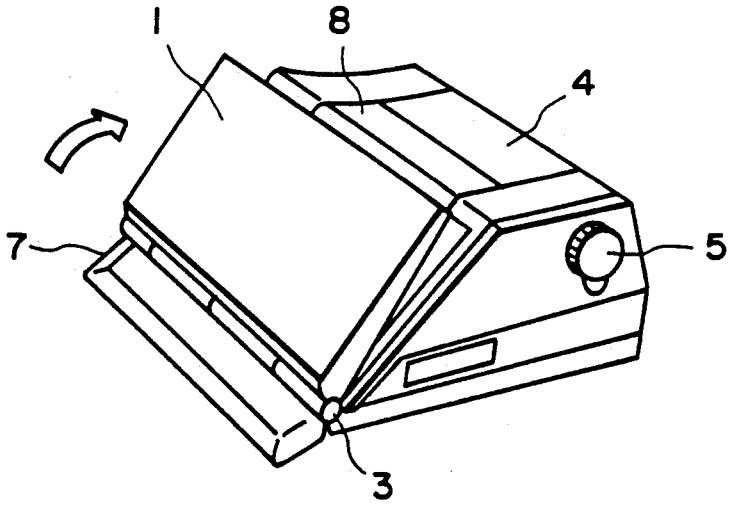

Referring to FIGS. 1A and 1B, there is shown an electronic typewriter to which the present invention is applicable.

It comprises a keyboard 1 having a group of keys such as, character keys, numerical keys, control keys or the like. The keyboard 1 is foldable by rotating about a hinge 3, as shown in FIG. 1B. A sheet feeding tray 4 accommodates recording mediums in the form of sheets to be supplied to the printer in the apparatus. When the apparatus is not used, the tray 4 is also foldable to cover the printer, as shown in FIG. 1B. The apparatus further comprises a sheet feeding knob 5 for permitting manual supply or discharge of the recording medium, a liquid crystal display (LCD) for displaying input sentences or the like, and a grip 7 used when the apparatus is carried around.

Figure 2:
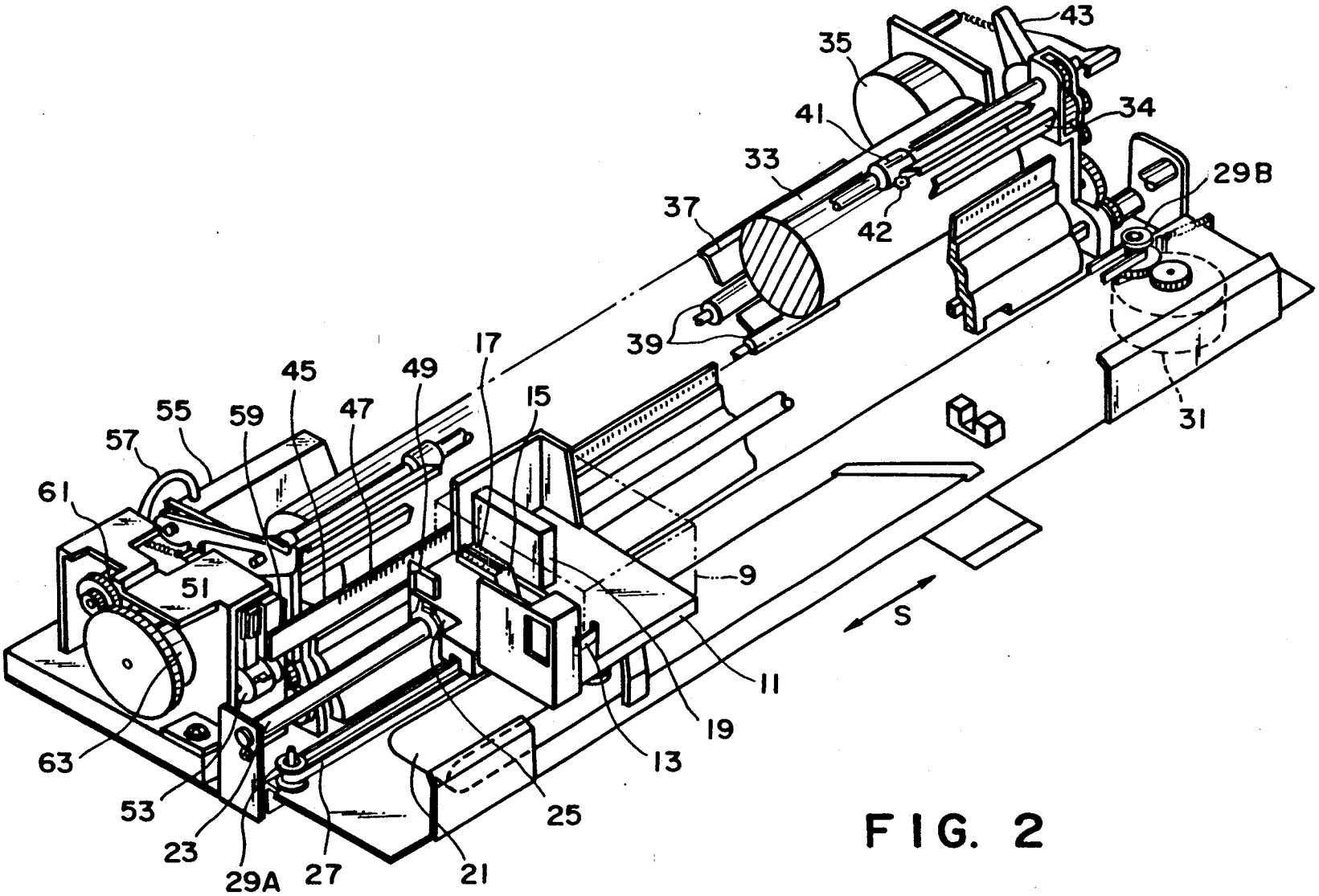
FIG. 2 is a perspective view of an example of a printer provided in the electronic typewriter of FIGS. 1A and 1B.

FIG. 2 shows the structure of the printer portion of the apparatus in this embodiment. It comprises a head cartridge 9 having an ink jet recording head which will be described in detail in conjunction with FIGS. 3 and 4, a carriage 11 for carrying the head cartridge 9 and moves it in a direction S (scan), a hook 13 for mounting the head cartridge 9 on the carriage 11, and a lever 15 for manipulating the hook 13. The lever 15 is provided with a marker 17 for indicating print position or set position of the recording head of the head cartridge, with the aid of scales on a cover which will be described hereinafter.

A supporting plate 19 supports electric connections relative to the head cartridge 9. A flexible cable 21 is used to electrically connect the electric connections with the controller of the main assembly of the apparatus.

A guiding shaft 23 guides the carriage 11 for the movement in the direction S and is supported by bearings 25. A timing belt 27 is fixed to the carriage 11 and transmits the driving power for the movement of the carriage 11 in the direction S and is stretched around pulleys 29A and 29B disposed at the lateral ends of the apparatus. To one 29B of the pulleys, the driving force is transmitted through transmission mechanism such as gear from a carriage motor (CM) 31.

A conveying roller 33 functions to confine the record surface of the recording medium (recording sheet) and also to feed the sheet during the recording operation or the like, and is driven by a sheet feeding motor (FM) 35. A paper pan 37 functions to lead the recording medium from the sheet feeding tray 4 to the recording position. A feed roller 39 is disposed in the sheet feeding passage and presses the recording medium to the conveying roller 33 to feed the recording medium. A platen 34 is effective to confine the surface to be recorded of the recording material and is faced to the ejection outlet side surface of the head cartridge 9. Sheet discharging rollers 41 are disposed downstream of the recording position with respect to the recording medium conveying direction to discharge the sheet. Spurs 42 are contacted to the sheet discharging rollers 41 to urge the recording medium to the rollers 41 to assist the discharging operation by the discharging rollers 41. A releasing lever 43 is provided to release the urging forces by the feed roller 39, confining plates and the spurs 42 when the recording medium is set in the apparatus, for example.

The confining plate 45 prevents bulging of the recording medium adjacent the recording position to assure the close contact of the recording medium to the conveying roller 33. In this example, the recording head is in the form of an ink jet recording head which ejects the ink for the recording. Therefore, the distance between the ink ejection outlet side surface of the recording head and the surface to be recorded of the recording material is relatively small, but the contact between the recording medium and the ejection side surface should be avoided, and therefore, the clearance is relatively strictly controlled. From this standpoint, the use of the confining plate 45 is effective. The confining plate 45 is provided with scales 47 which are used with the aid of a marker 49 on the carriage 11. Using them, the printing position and the set position of the recording head are known, too.

A cap 51 is faced to the ejection outlet side surface of the recording head at its home position and is made of elastic material such as rubber. It is supported for contact to and separation from the recording head. The cap 51 is used to protect the recording head when the recording operation is not carried out, and is also used when a ejection recovery operation for the recording head is carried out. The recovery operation is an operation in which energy generating elements, provided upstream of the ink ejection outlet with respect to the direction of the ink flow in the recording head to produce energy for ejecting the ink, are driven to eject the ink from all of the ejection outlets, so that the causes for the improper ejection such as bubbles, dust, the ink having increased viscosity, or the like are removed (preliminary ejection), and in which the ink is forcedly discharged through the ejection outlets, additionally, to remove the improper ejection causes.

A pump 53 provides sucking force for the forced ink ejection. It is also used to suck the ink received by the cap 51 at the time of the ejection recovery operation by the forced ejection or at the time of the ejection recovery operation by the preliminary ejection. The residual ink sucked by the pump 53 is contained in a residual ink container 55 for containing the residual ink, through a tube 57 connecting the pump 53 and the residual ink container 55.

A wiping blade 59 wipes the ejection outlet side surface of the recording head, and is supported for movement between a wiping position in which it is projected to the recording head to wipe the recording head during movement thereof and a retracted position in which the blade 59 is out of contact with the ejection side surface. A cam 63 is connected with a motor (SM) 61 to drive the pump 53 and to move the cap 51 and the blade 59.

Figure 3:
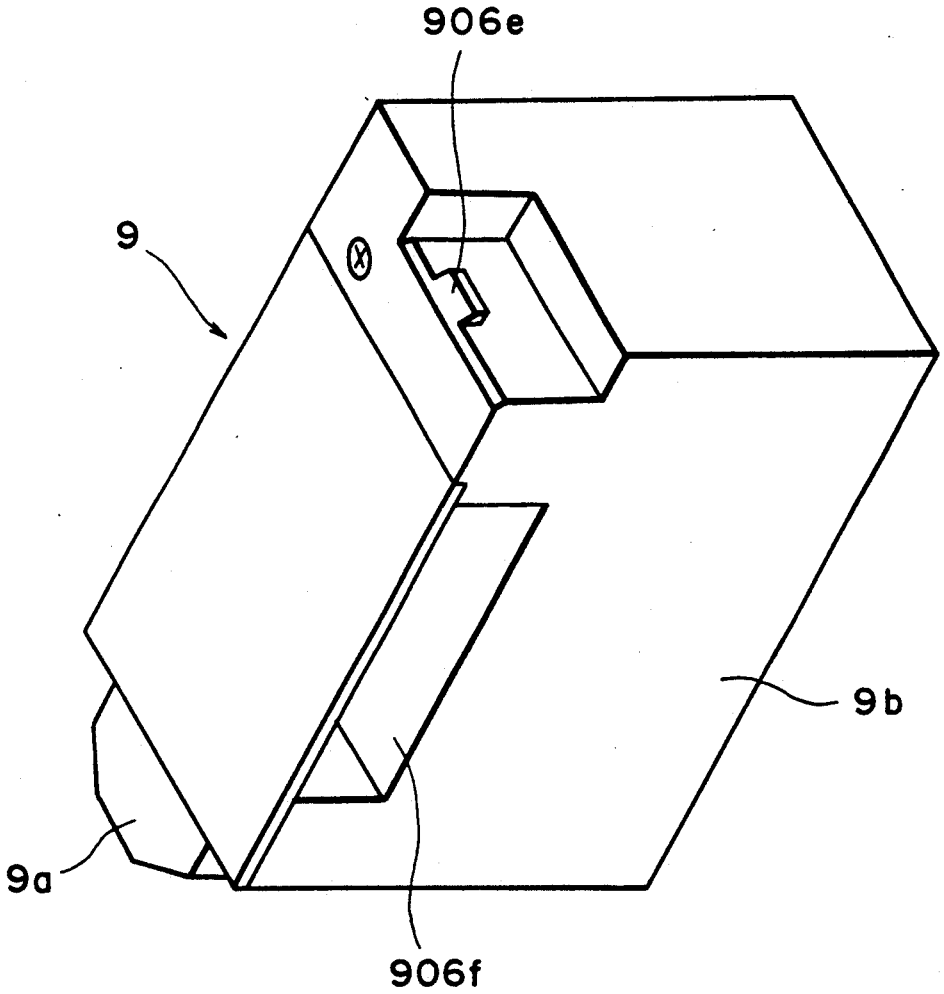
FIG. 3 shows an outer appearance, in a perspective view, a head cartridge of FIG. 2.

The description will be made as to the head cartridge 9. FIG. 3 shows an outer appearance in a perspective view of a head cartridge 9 having an integral ejection unit **9*a* and an ink container 9*b* which constitute the main assembly of the ink jet recording head. It comprises a pawl 906*e* engageable with the hook 13 of the carriage 11, when the head cartridge 9 is mounted on the carriage. As will be understood from FIG. 3, the pawl 906*e* is disposed inside the entire length of the recording head. Adjacent the ejection unit 9*a* of the head cartridge 9, there is a positioning abutment portion, although it is not shown. A head opening 906*f* is formed in the carriage 11** to receive a flexible base (electric connection) and a rubber pad.

Figure 4A:
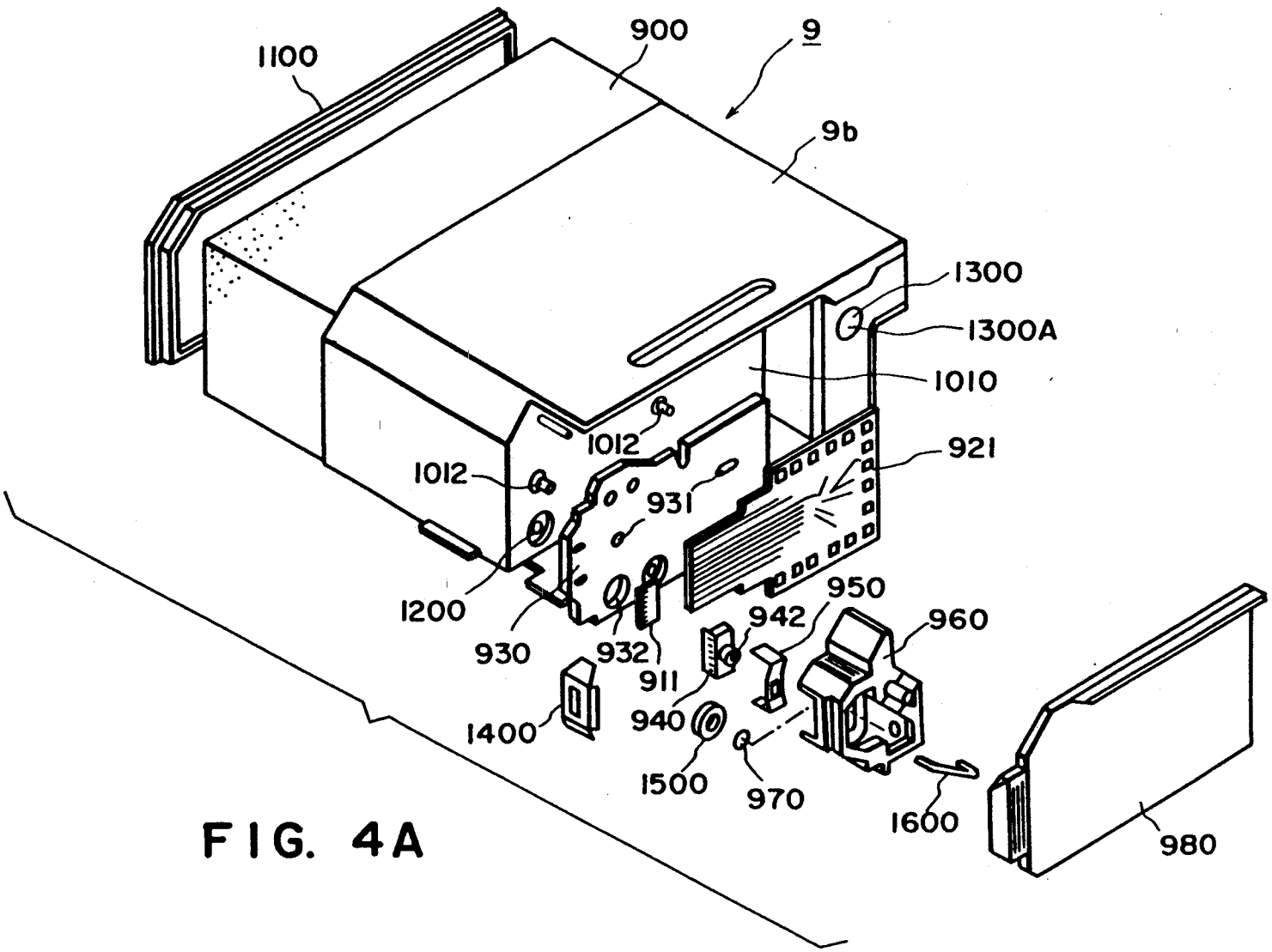
FIGS. 4A and 4B are an exploded perspective view and a perspective view of an outer appearance of a head cartridge shown in FIG. 3.
Figure 4B:
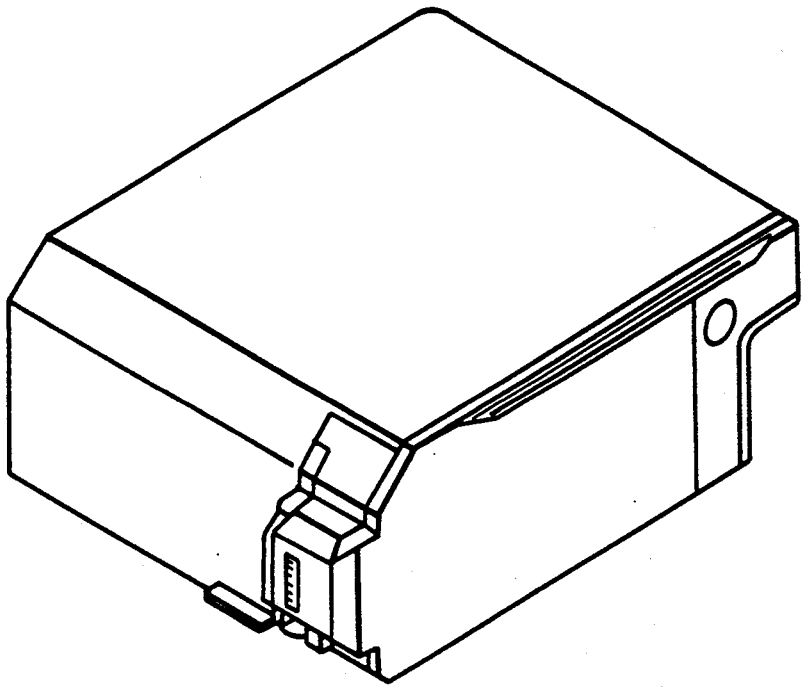

FIGS. 4A and 4B show an exploded perspective view of the head cartridge shown in FIG. 3. As described above, it is a disposable or replaceable type having an integral ink container (ink source).

Referring to FIG. 4A, a heater board 911 comprises Si substrate, the number of electrothermal transducer elements (ejection heaters) corresponding to the number of ejection outlets, a temperature keeping heater or heaters having an electrothermal transducer element or elements, and aluminum wiring for supplying electric power thereto. They are formed on the substrate through a film forming process. Corresponding to the heater board 911, there is provided a wiring board 921, and the corresponding wiring is properly connected by wire bonding or the like. A top plate 940 has partition walls for defining ink passages and a common liquid chamber. In this embodiment, the top plate 940 is also provided with an integral orifice plate.

The heater board 911 and the top plate 940 are clamped between a metal supporting member 930 and a clamping spring 950 so that the heater board 911 and the top plate 940 are securedly fixed by the spring force of the clamping spring 950. The supporting member 930 may function to support the wiring board 921 mounted thereto by bonding or the like, and also functions as an index for positioning the head relative to the carriage 11. The supporting member 930 may function to radiate the heat of the heater board 911 produced by the driving of the recording head.

The recording head comprises a supply ink container 960 which is supplied with the ink from the ink supply source in the form of an ink container **9*b*, and it functions as a subordinate container for supplying the ink to the common liquid chamber constituted by the heater board 911 and the top plate 940. A filter 970 is disposed in the supply container 960 adjacent an ink supply port to the common liquid chamber. The supply container 960 has a cover 980**.

An ink absorbing material 900 for retaining the ink is packed in the ink container **9*b*. An ink supply port 1200 supplies ink to the ejection unit 9*a* constituted by the elements 911–980. Before the unit is mounted to the portion 1010 of the ink container main assembly 9*b*, the ink is injected through the supply port 1200, so that the absorbing material 900** absorbs the ink.

Designated by a reference numeral 1100 is a cover for the main assembly of the cartridge, which is provided with an air vent for communication between the inside of the cartridge and the ambience. The inside of the air vent 1400 is provided with a water repelling material 1300, so that the ink is prevented from leaking through the air vent 1400.

When the ink container **9*b* is filled with the ink through the supply port 1200, the ejection unit 9*a* constituted by the elements 911–980 is mounted to the portion 1010 at the correct position. The positioning and the securing is assured by engagement between the projections 1012 of the main assembly of the ink container and corresponding holes 931 in the supporting member 930. Thus, the head cartridge 9 as shown in FIG. 4B** is provided.

The ink is supplied from the inside of the cartridge to the supply container 960 through the support port 120, the opening 932 in the supporting member 930 and an opening formed in the backside of the supply container 960 (FIG. 4A). Then, the ink is supplied to the common liquid chamber through proper supply pipe and ink inlets 942 of the top plate 940. The connecting portions along the ink passage are provided with gasket made of silicone rubber or butyl rubber or the like, so that the connecting portions are hermetically sealed to assure the flow of the ink.

Figure 5A:
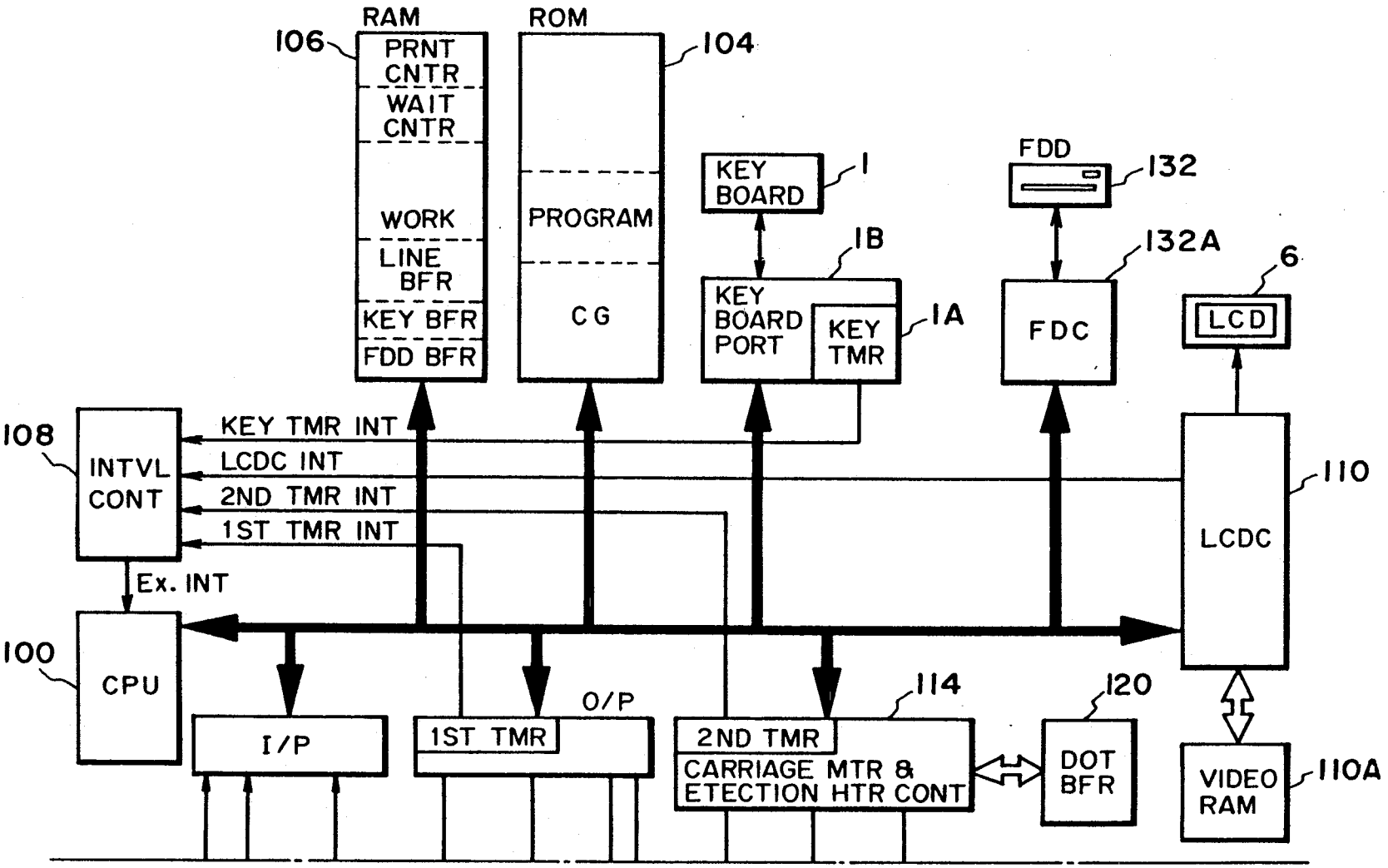
FIG. 5A and 5B is a block diagram of a control system for the electronic typewriter shown in FIGS. 1A and others.
Figures 5, 5B:
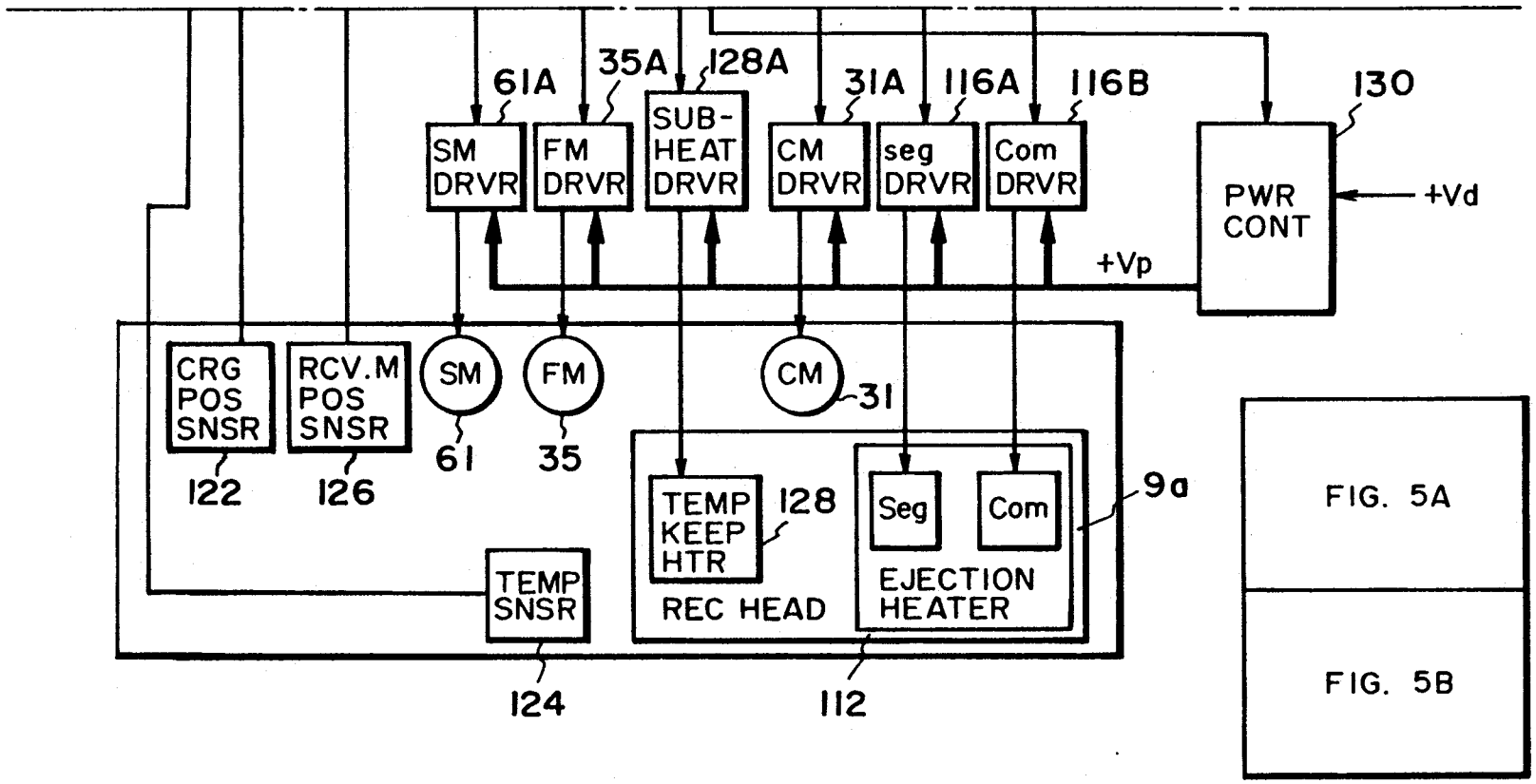
FIG. 5 which comprise

FIG. 5 is a block diagram of a control system for the electronic typewriter according to this embodiment.

It comprises as the major part a CPU 100 in the form of a microprocessor to execute proper process in accordance with data from the keyboard 1 and the control signals, a ROM 104 storing a program corresponding to the record control process executed by the CPU 100, a character generator (CG) and other fixed data, a RAM having a work area usable as a register or the like, a line buffer for storing print data for one line, a key buffer for storing key input data, an FDD buffer for storing the data read out of a floppy disk, and an operational area for the print counter for the printing time and the waiting counter for counting the waiting time, or the like. An interval control circuit 108 functions to accept the key inputs to the keyboard 1 at the predetermined interval by supplying to the CPU 100 key interval interruption signals having the predetermined interval in accordance with the interruption signals produced by a key timer 1A. Also, it produces interruption signals in response to LCDC interruption signal relating to display and drive for the display 6, a second timer interruption signal from a second timer relating to the drive of the carriage motor and the ejection heaters, and first timer interruption signal from a first timer for controlling drive of the conveying motor 35 and the temperature keeping heater 128. A display controller 110 functions to display the data on the display 6 in the form of a liquid crystal display (LCD).

A head controller 114 incorporating the second timer produces control signals for a head driver 116 (segment drivers 116A, a common driver 116B) for actuating or driving the ejection energy generating elements of the ejection unit (recording head) 9a and the control signals for the carriage motor driver 31A. Designated by 61A, 35A and 128A are an SM driver, an FM driver and sub-heat driver for driving a recovery system motor 61, a conveying motor 35 and the temperature keeping heater 128, respectively.

A print dot buffer 120 processes the data received thereby for printing and stores the dot data for one line for the recording, and comprises a print buffer area PB. It may comprise an input buffer area IB to store the data in the dot buffer 120 when the head controller 114 is provided with an interface for receiving external data. A carriage position sensor 122 detects a predetermined position of the carriage 11; a motor position sensor 126 detects the rotational position of the recovery system motor 61; and a temperature sensor 124 detects the ambient temperature around the recording head 9a, in other words, the ambient temperature of the apparatus. A power source controller 130 responsive to instructions (recording mode) from the output port controls the voltage Vp to be supplied to the drivers 31A, 35A, 61A, 116A, 116B and 128A. By controlling the voltage Vp, the driving torque for the carriage motor 31 can be increased so as to increase the speed of the carriage movement. For example, it supplies 18 V in the fine recording mode and supplies 24 V in the draft recording mode. Designated by 132 is a floppy disk drive; and 132A is a floppy disk drive controller.

Figure 6:
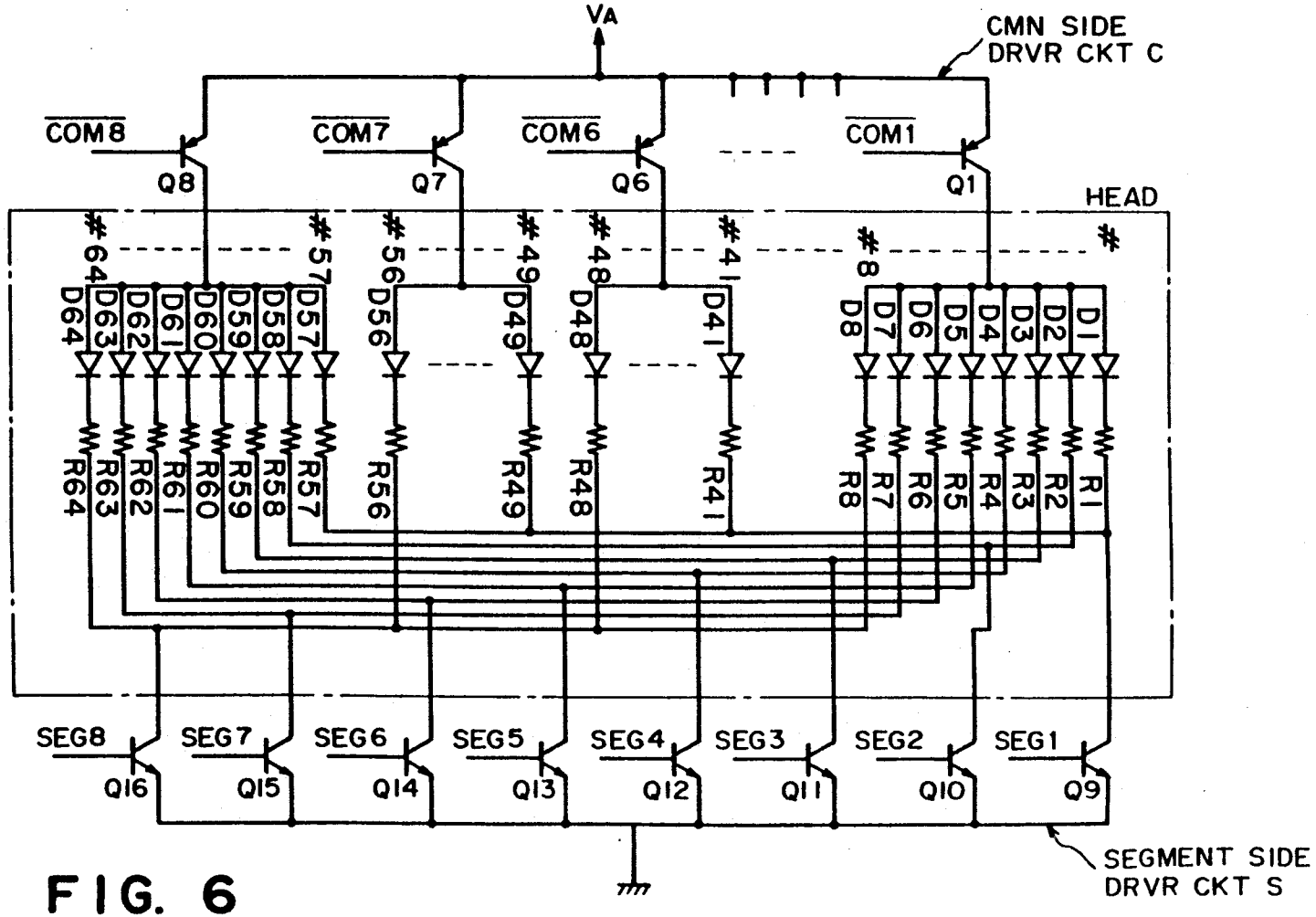
FIG. 6 is a circuit diagram of an example of a circuit of the recording head and the driver therefor, of a printer in a character processor.

FIG. 6 shows an example of electric structure of the recording head and the head driver 116. In this embodiment, the ejection unit 9a is provided with 64 ejection outlets, and #1–#64 in FIG. 6 correspond to the number positions of the ejection outlets in the ejection unit 9a. Designated by R1–R64 are electrothermal transducer elements in the form of heat generating resistors for the respective ejection outlets #1–#64. The heat generating resistors R1–R64 are grouped into 8 blocks each containing 8 ejection outlets, and the resistors in a certain block are commonly connected with an associated switching transistor Q1–Q8 in a common driver circuit C. The transistors Q1–Q8 are responsive to on/off of the control signals $\overline{\text{COM1}}$–$\overline{\text{COM8}}$ to connect or disconnect the power supply paths. In the paths for the heat generating resistors R1–R64 and, diodes D1–D64 for preventing opposite direction flow of the current.

The counterpart heat generating resistors in the respective blocks are connected with an on/off transistor Q9–Q16 in a segment driver circuit S. The transistors Q9–Q16 are responsive to on/off of the control signals SEG1–SEG8 to connect or disconnect the power supply paths to the associated heat generating resistors.

Figure 7:
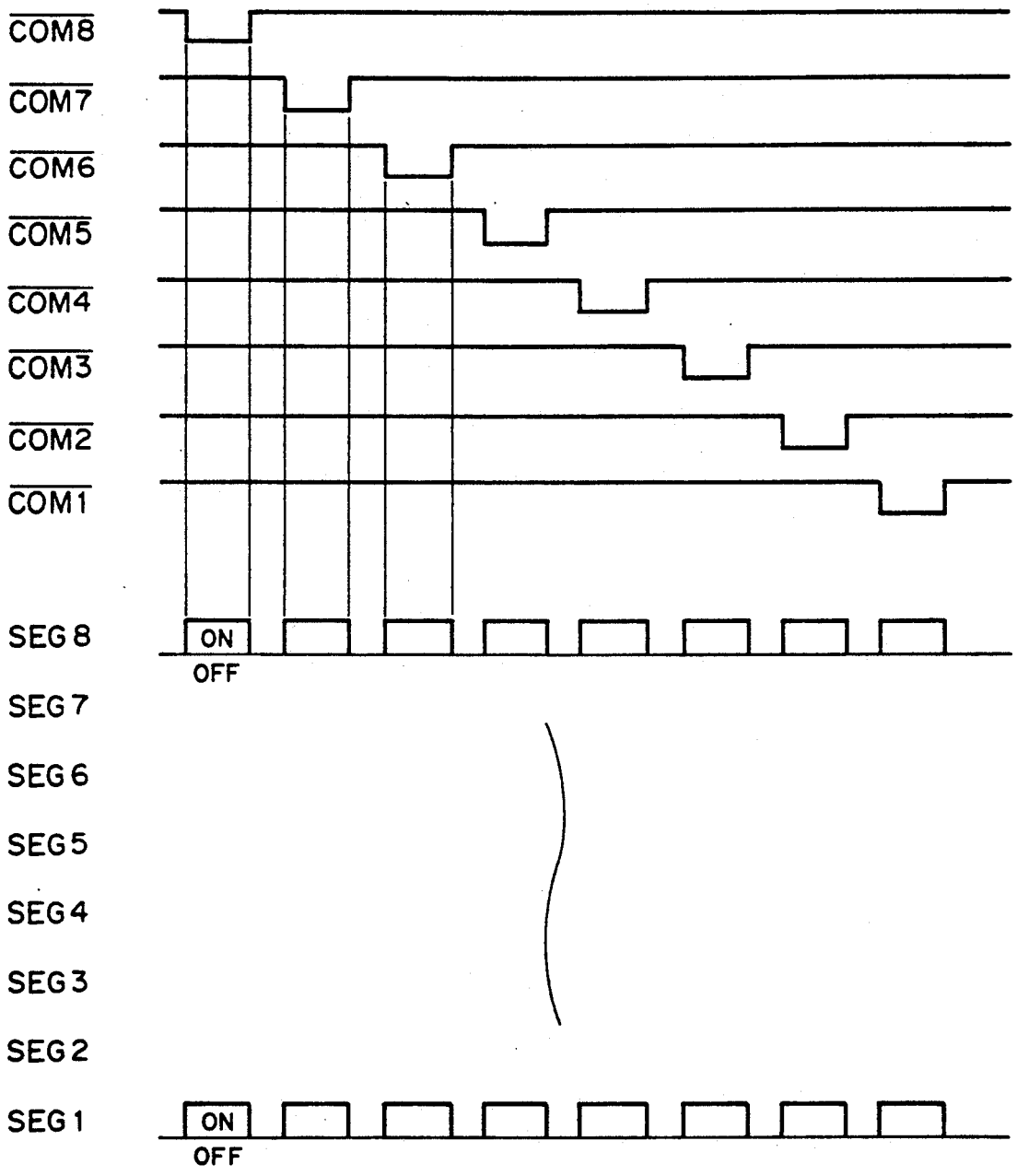
FIG. 7 is a timing chart of the head drive.

FIG. 7 is a timing chart of the head drive. At a certain position along the head scan, the common control signals $\overline{\text{COM8}}$–$\overline{\text{COM1}}$ are sequentially actuated. By the actuation one block is selected to enable power supply. In the selected block, the segment control signals SEG8–SEG1 are selectively rendered on or off in accordance with the image to be recorded, by which the heat generating resistors are selectively supplied with the electric power, upon which the ink is selectively ejected in response to the heat generation, so that the dot recording is effected.

Figure 8:
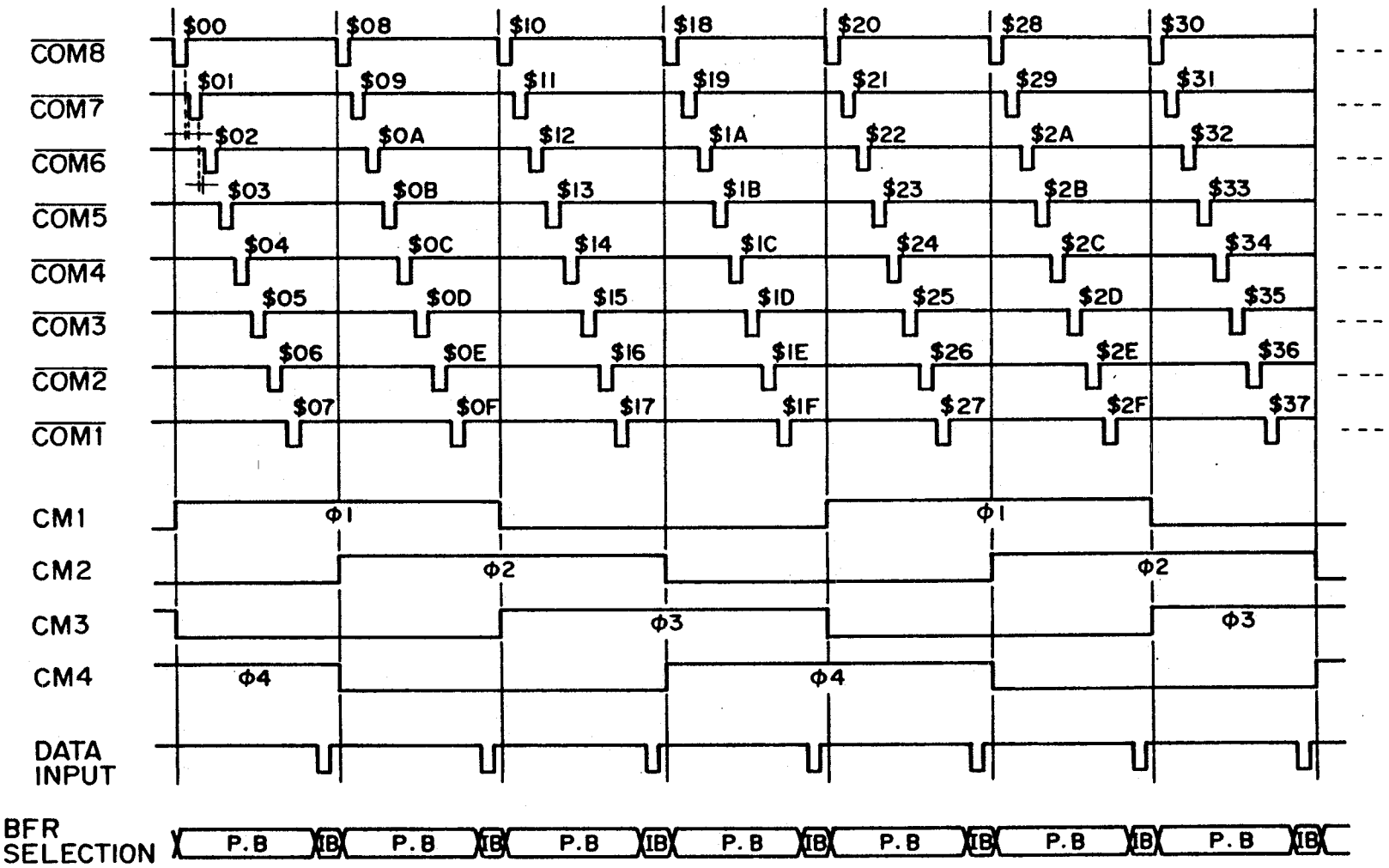
FIG. 8 is a timing chart of an example of the operational timing of various portions of the head controller in this embodiment.

FIG. 8 is a timing chart illustrating the output timing of the signals $\overline{\text{COM8}}$–$\overline{\text{COM1}}$ during the recording by the head controller (carriage motor and ejection heater control circuit) 114 and output timing of the motor drive signals CM1–CM4. The figure also shows the data receiving timing and selection timing for the areas PB and IB of the dot buffer 120 in the case where the head controller 114 is provided with an interface for receiving external data. In the Figure, one dot in the scanning direction corresponds to one step of the motor.

As shown in the Figure, during the recording at a position in the scanning direction, the buffer area PB is selected, and the addresses (for example $00–$07) storing the data to be printed on that position are sequentially designated, so that the data are selected and outputted, by which the signals $\overline{\text{COM8}}$–$\overline{\text{COM1}}$ are sequentially outputted, and the signals SEG8–SEG1 are produced corresponding to the data at the timing for the respective outputs, as shown in FIG. 7. Thus, the recording operation is carried out. Upon the completion of the recording action at this position, the buffer area IB is selected, and the received data are stored.

Figure 9:
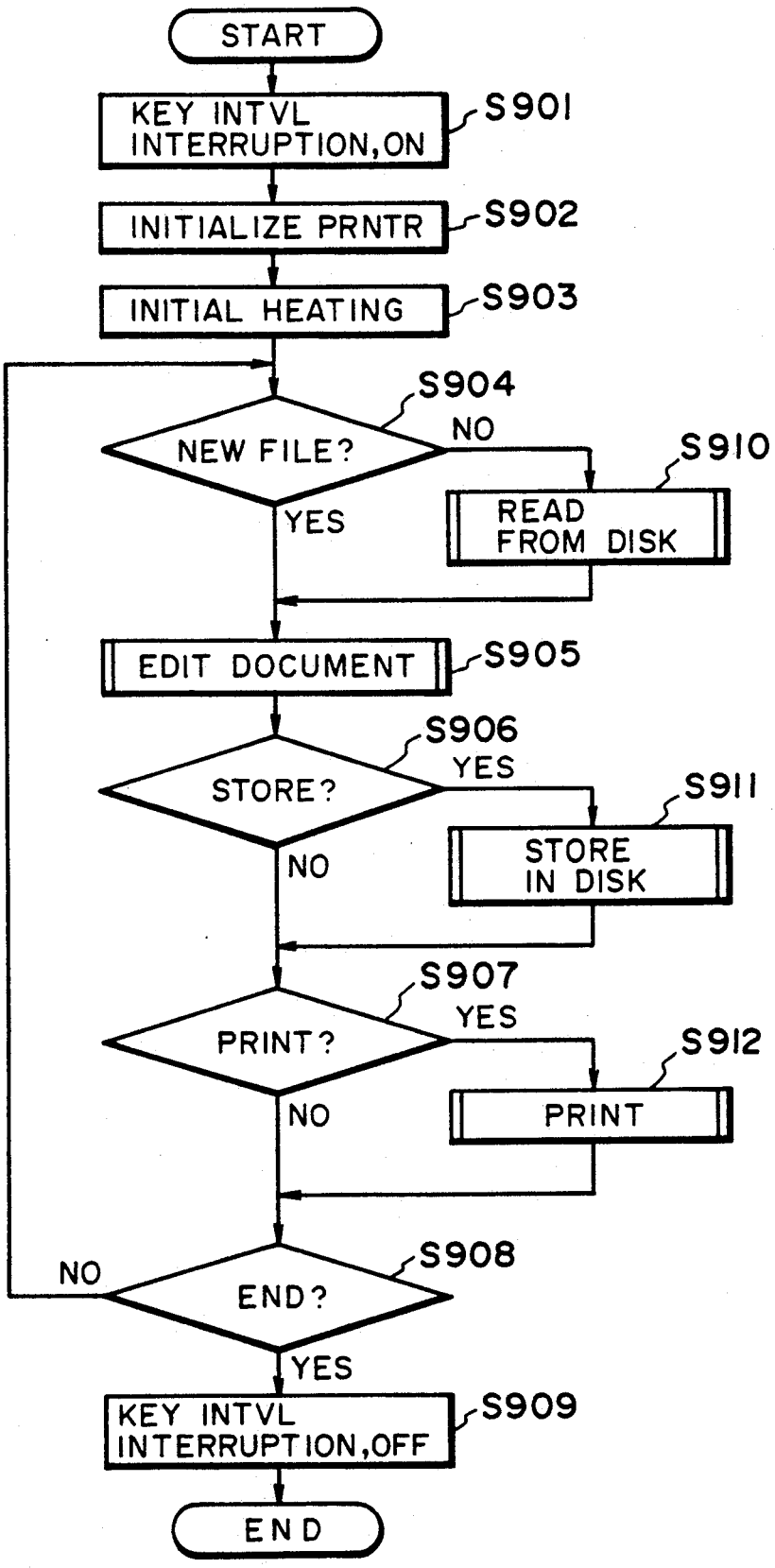
FIG. 9 is a flow chart of operations of the electronic typewriter.
Figures 1, 10A:
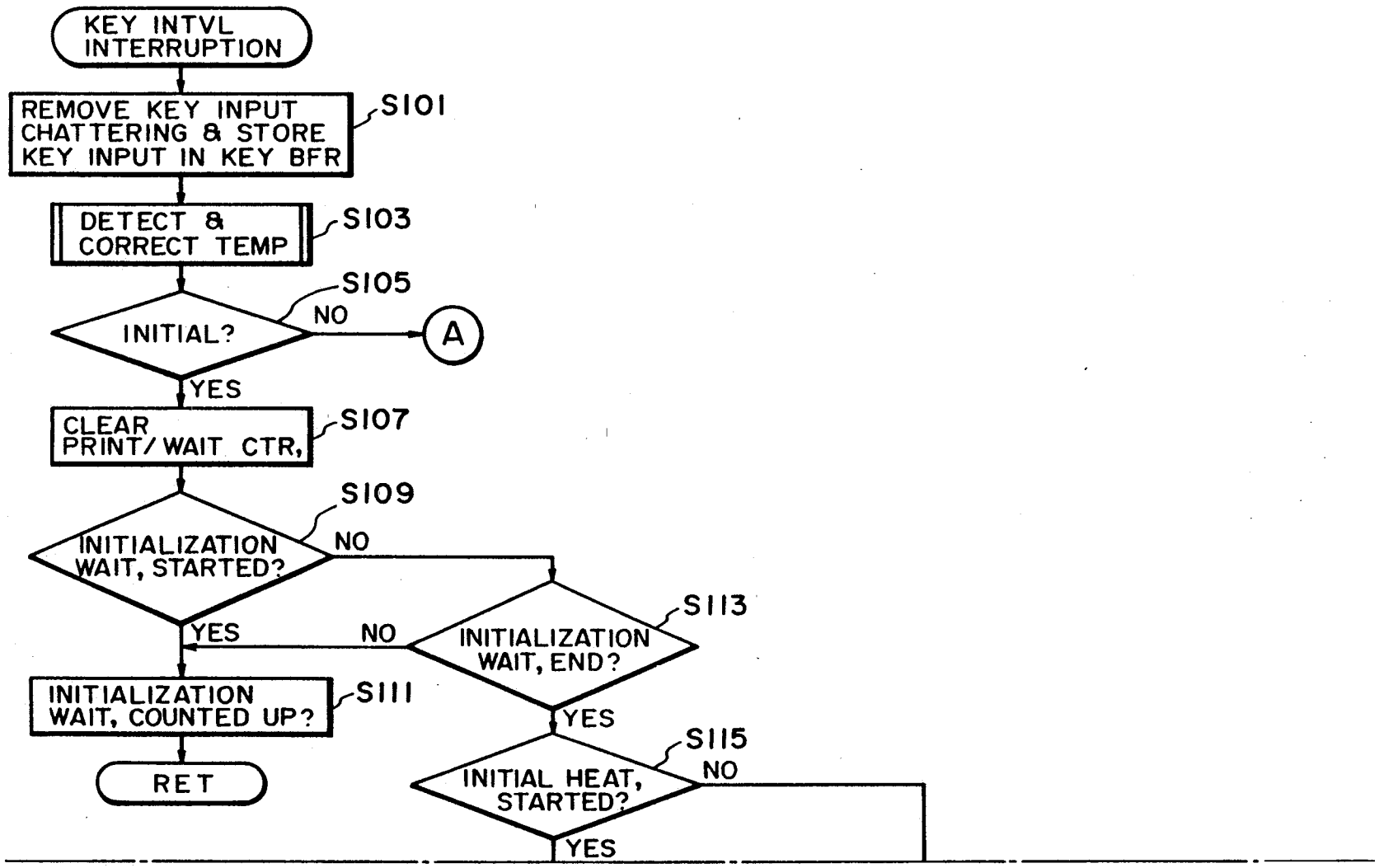
FIGS. 10A to 10D show a flow chart of a sub-heat control process by key interval interruption.
Figures 2, 10A:
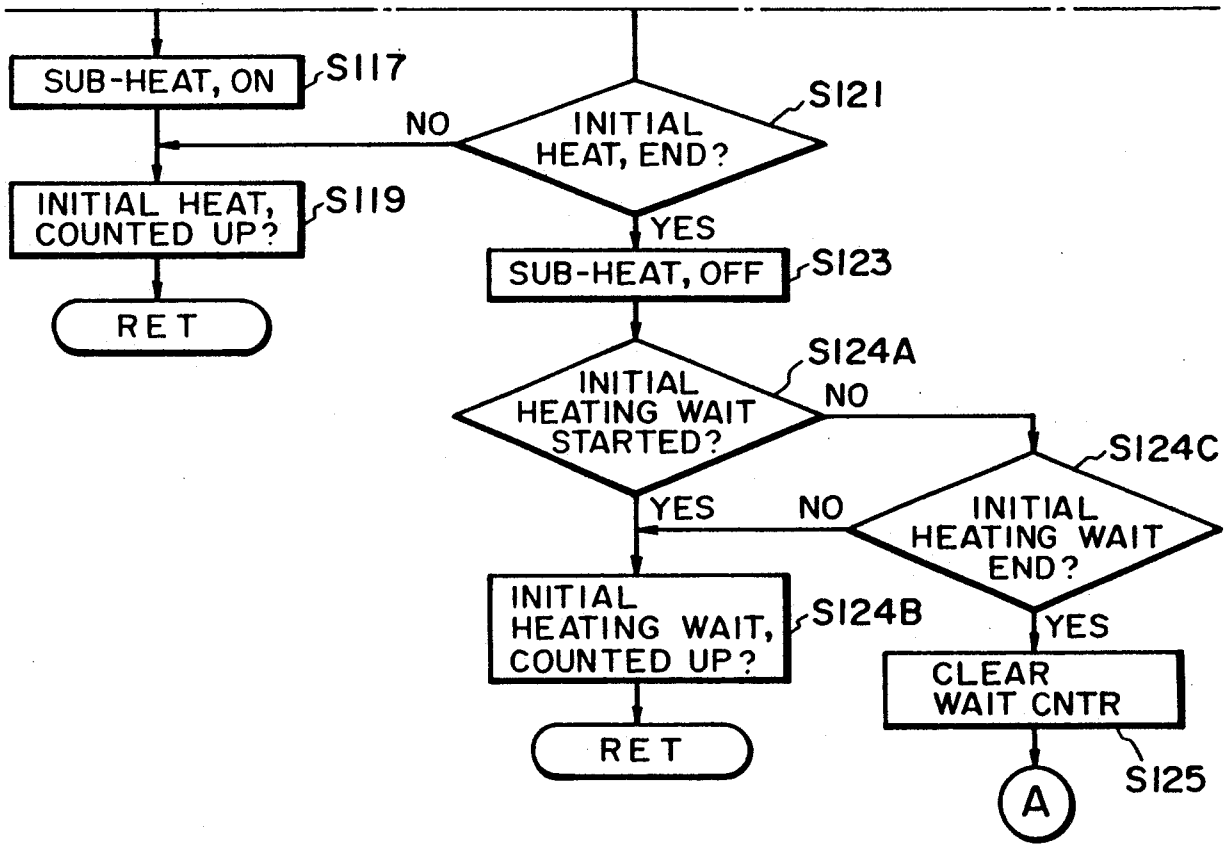
Figure 10A:
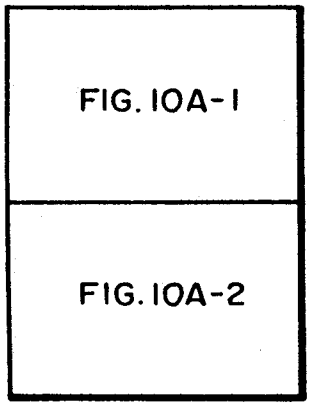
Figures 1, 10B:
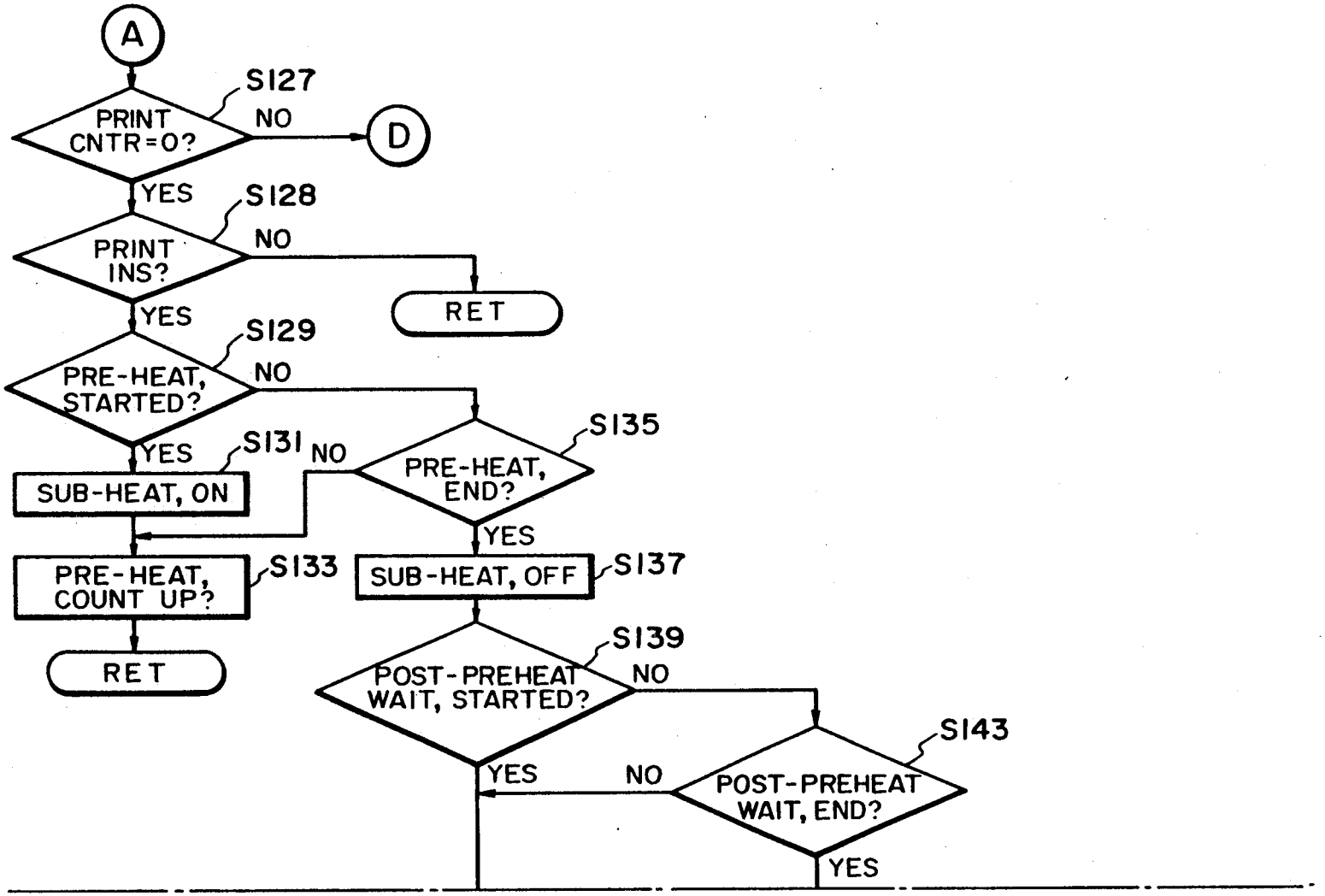
Figures 2, 10B:
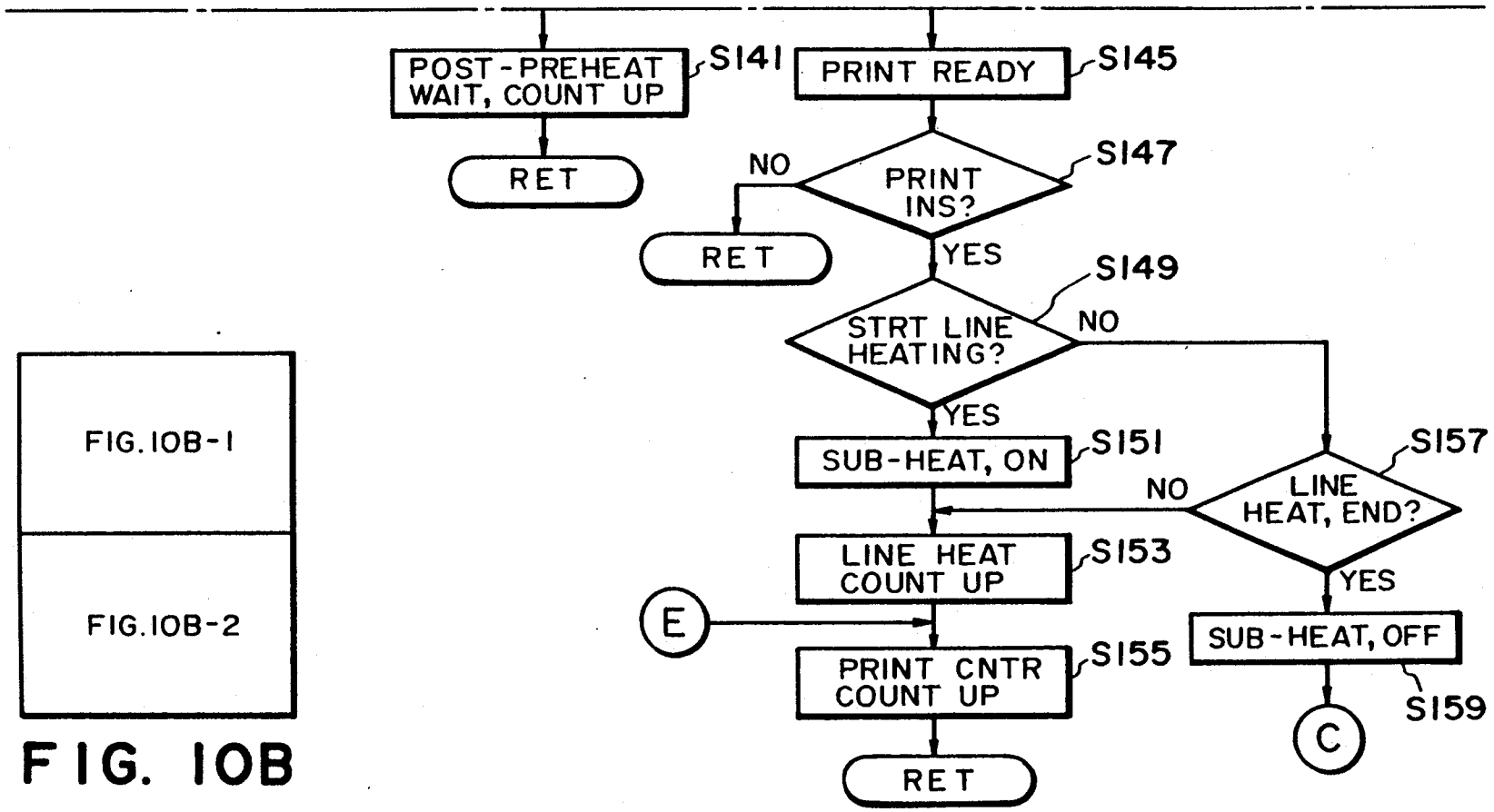
Figures 1, 10C:
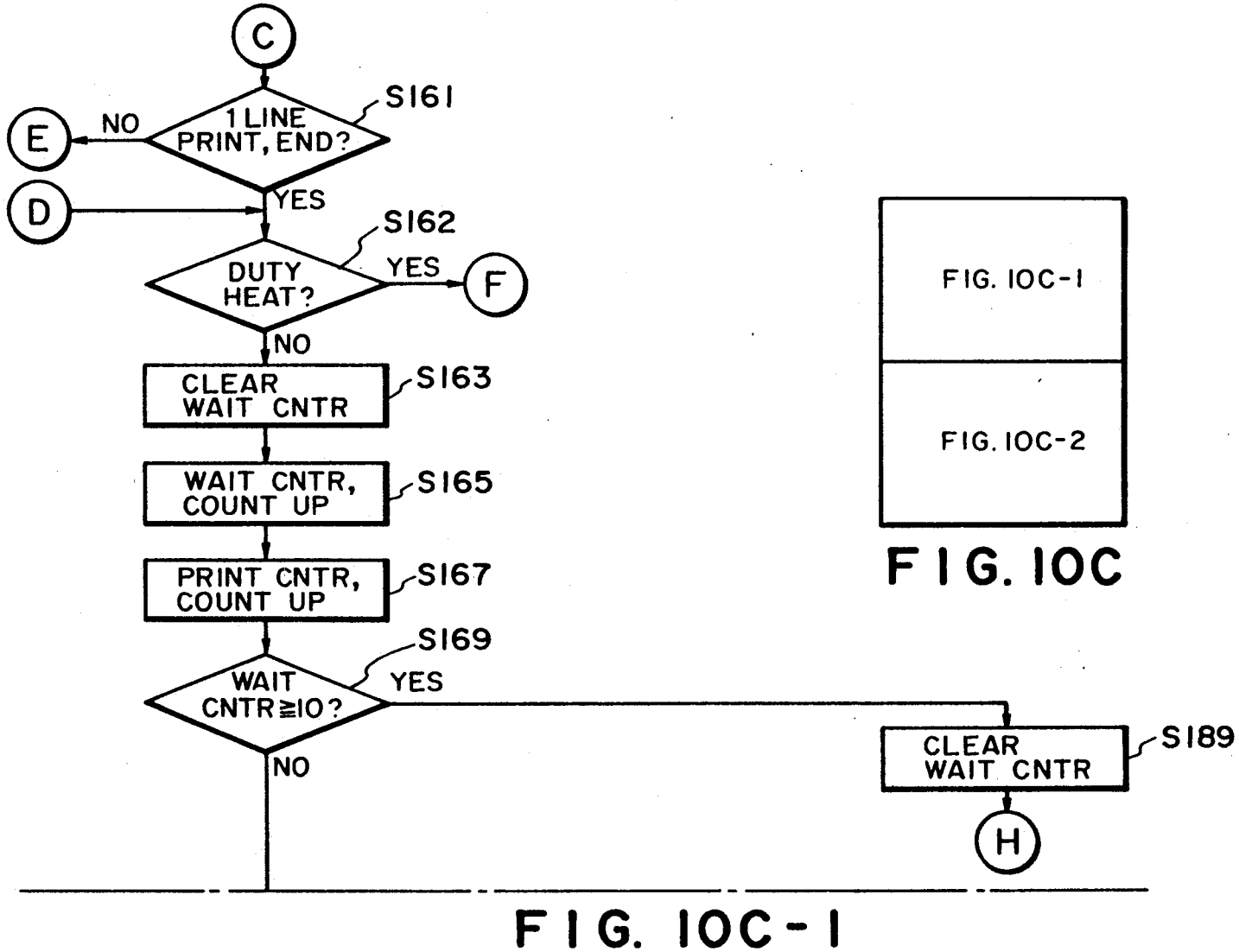
Figures 2, 10C:
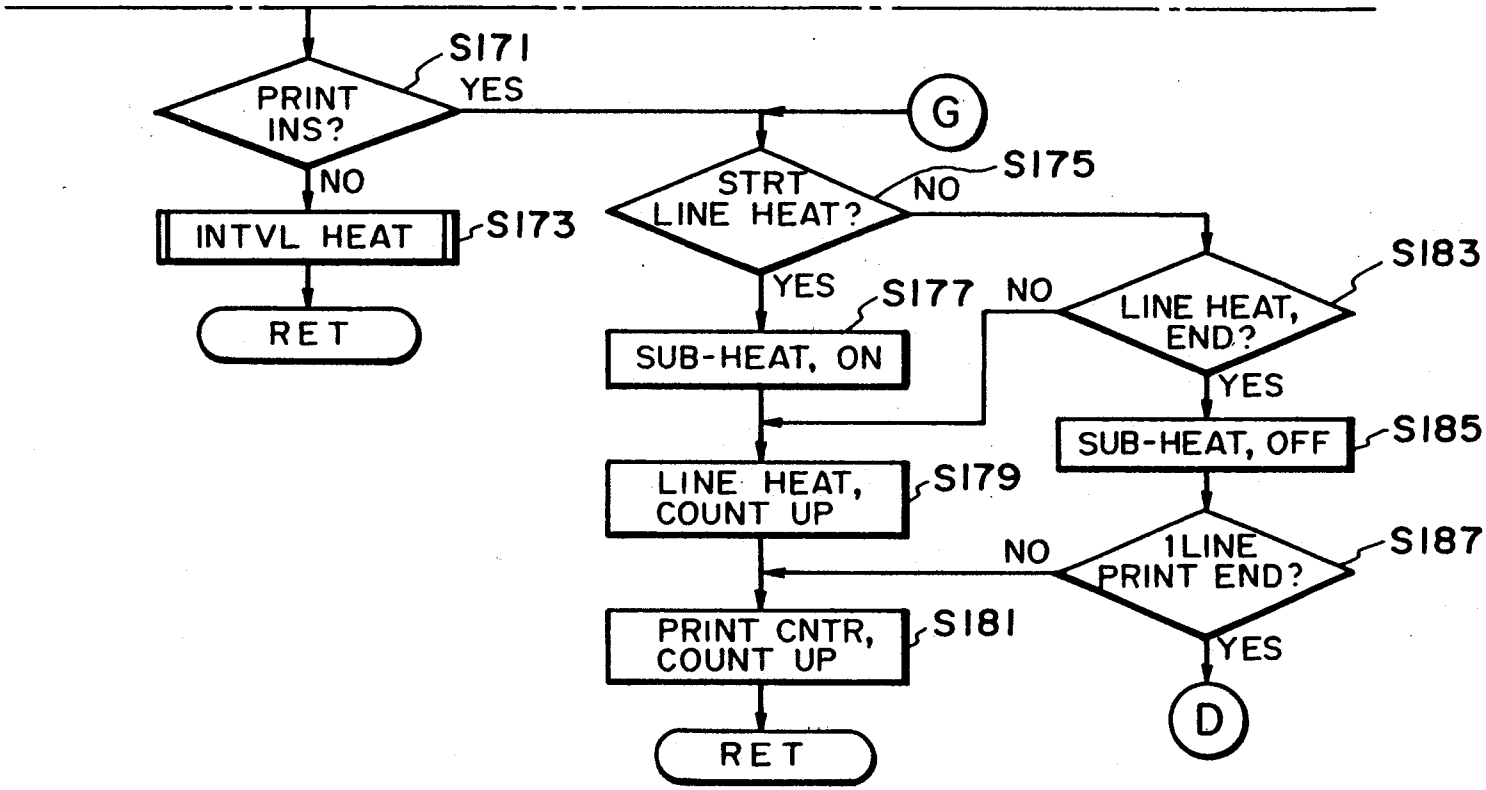
Figure 10D:
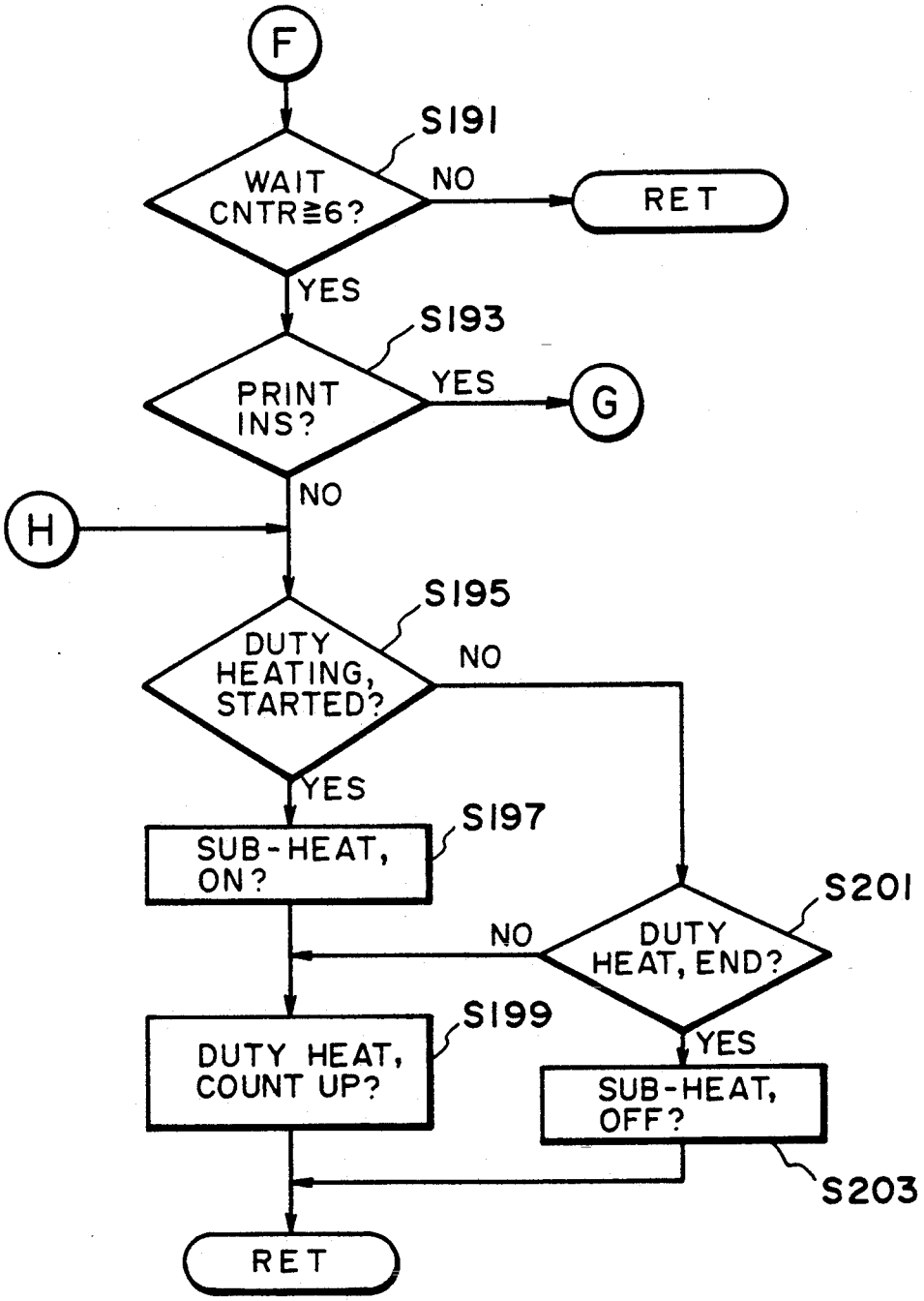

FIG. 9 is a flow chart illustrating sequential operations for editing and printing in the electronic typewriter in this embodiment. When the main switch of the electronic typewriter is actuated, the sequential operation starts. At step S901, the key interval interruption on the basis of the key timer becomes receptable. Then, at step S902, the initial operation for the printer such as ejection recovery operation for the recording head or the like is performed. At step S903, an initial heating operation which is one of the sub-heat operations, is executed.

Figure 15:
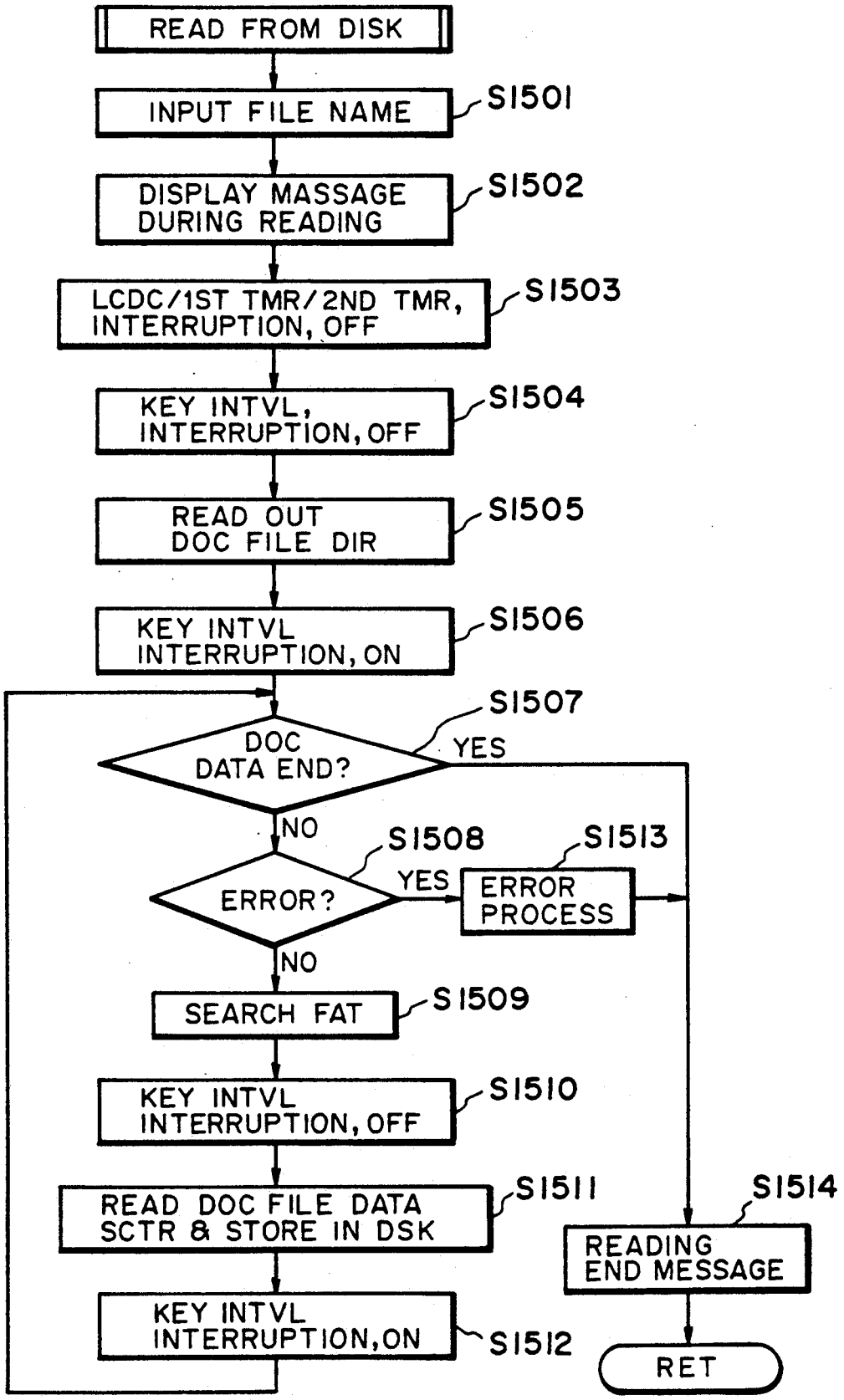
FIG. 15 is a flow chart illustrating the operations for the reading from a disk shown in FIG. 9.

At step S904, S905 or S910, the processing is carried out corresponding to the editing by the operator using the keys. More particularly, the discrimination is first made at step S904 as to whether or not a new file is intended or not. With the electronic typewriter of this embodiment, the printing operation is possible without editing the information supplied by the keys. In addition, it is possible to print a new file without storing the data thereof in a disk. Such processing is included in the editing and the printing. If the discrimination at the step S904 is affirmative, that is, the new file is intended, the operation proceeds to step S905. If the discrimination at the step S904 is negative, a reading operation which will be described hereinafter in conjunction with FIG. 15 is carried out, and the editing is carried out at step S905.

At step S906, the discrimination is made as to whether or not the finished document file is to be stored in the disk. If so, the file is stored at step S911, and then the operation proceeds to step S907.

At step S907, the discrimination is made as to whether or not the printing operation is executed. If so, the printing operation is effected at step S912, including ink ejection from the recording head 9 to the recording sheet in accordance with movement of the carriage 11 and recording sheet conveyance for each of the printing lines. At step S908, the discrimination is made as to whether or not the process is to end. If not, the operation returns to the step S904. If so, the key interval interruption is accepted at step S909 to enable the acceptance, and the sequential operation ends.

As described in the foregoing, when the CPU 100 controls the editing or printing operations or the like, the key interval interruption on the basis of the key timer 1A is acceptable, and therefore, various key input information during the above is accepted by the key interval interruption. In addition, in this embodiment, utilizing the interruption timing, the timing for the printing period measurement and the waiting period measurement is generated, and various sub-heat control operations are carried out on the basis of the time measured.

The sub-heat controls in this embodiment are directed to (1) the initial heating for quickly increasing the temperature of the recording head upon actuation of the main switch, (2) the pre-heating for quickly increasing the head temperature immediately before the first printing after the actuation of the main switch, (3) the line heating carried out for the printings for respective printing lines, (4) the interval heating carried out in the short rest period between adjacent printing lines to maintain the constant head temperature, and (5) the duty heating for keeping the constant head temperature during the print waiting period. In the sub-heat control operation, a table indicative of the sub-heat period is used to maintain the recording head temperature at a target temperature during the printing period and the print waiting period except for the period immediately after the actuation of the main switch.

FIGS. 13A–13E show examples of the tables. FIG. 13A shows a table for the initial heating; FIG. 13B shows a table for the pre-heating; FIG. 13C shows a table for the line heating in the draft recording mode; FIG. 13D shows a table for the line heating in the fine recording mode; and FIG. 13E shows a table for the duty heating. As for the interval heating, the reference is made to the table for the line heating, and the sub-heat period is selected, and then, the heating operations are carried out at 1 sec intervals.

As will be understood from these Figures, two parameters are used for determining the sub-heat period (the power supply period to the temperature keeping heater 128) in each of the tables. The two parameters are print waiting period or printing period and a rank determined on the basis of the ambient temperature (actually an average of plural detections) by the temperature sensor 124.

The ranks are determined in the following manner: The reference is made to the table of FIG. 14 which has been made taking into account the hysteresis of the temperature detection, and for the rising temperature. Rank 0 corresponds to the temperature not more than 14° C.; rank 1, 14°–16° C.; rank 2, 16°–18° C.; rank 3, 18°–21° C.; and rank 4, not less than 21° C. Also in consideration of the hysteresis, for the decreasing temperature, rank 0 corresponds to not more than 13° C.; rank 1, 13°–15° C.; rank 2, 15°–17° C.; rank 3, 17°–20° C.; and rank 4, not less than 20° C. The line heating is carried out during acceleration of the carriage, and the common electric power source is used for the drive of the carriage and for the heater 128. For these reasons, the line heating operations are different between the normal fine mode operation and the draft mode operation in which the carriage speed is doubled. To accomplish this, the respective tables (13C and 13D) are provided. This also applies to the interval heating. As described above, the different tables for the heating period are used in accordance with the carriage speeds (driving source), and therefore, the supply of the thermal energy per unit time can be maintained constant.

Figure 11:
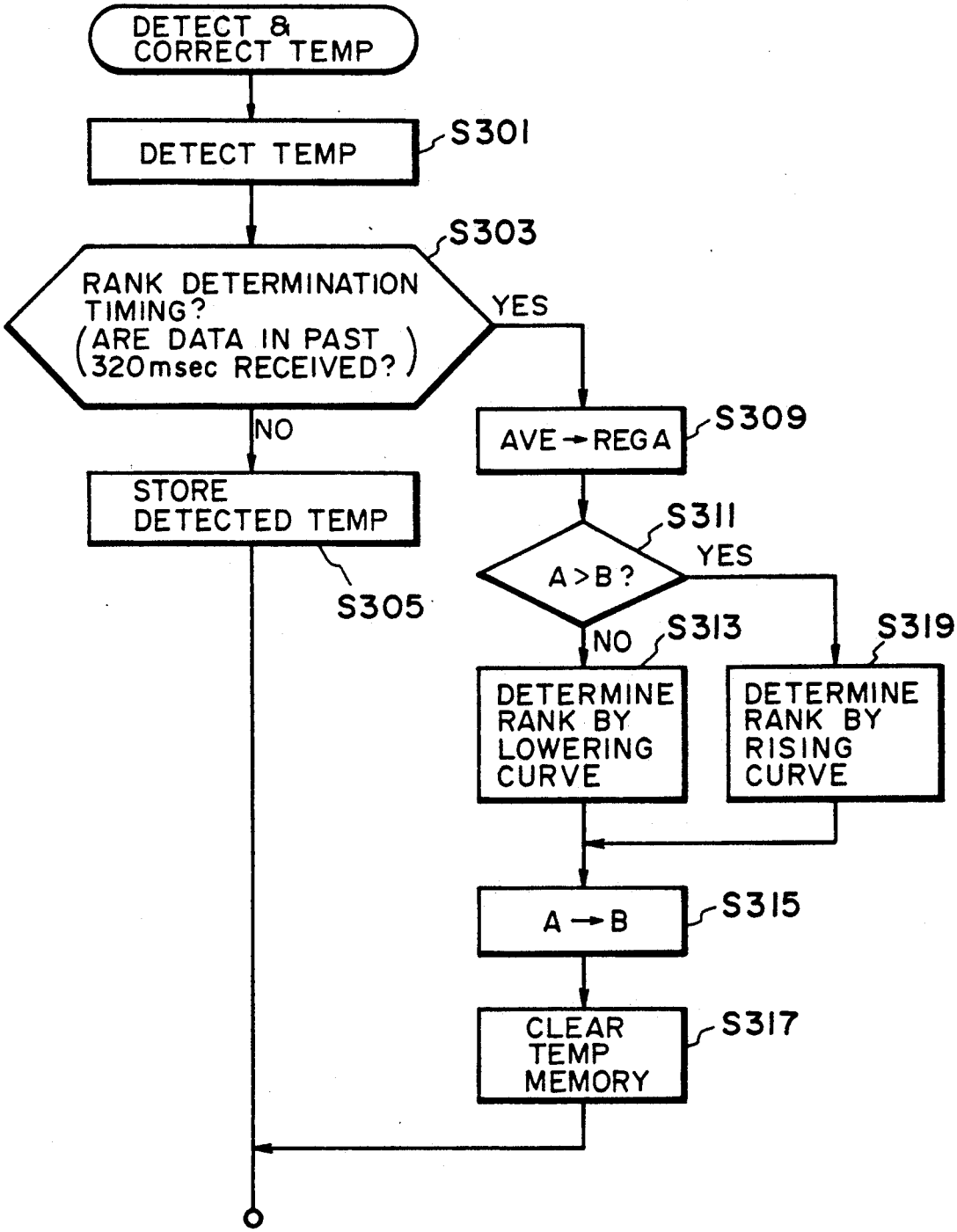
FIG. 11 is a flow chart showing the detail of a temperature detecting operation and a temperature correcting operation shown in FIGS. 10A to 10D.
Figure 12:
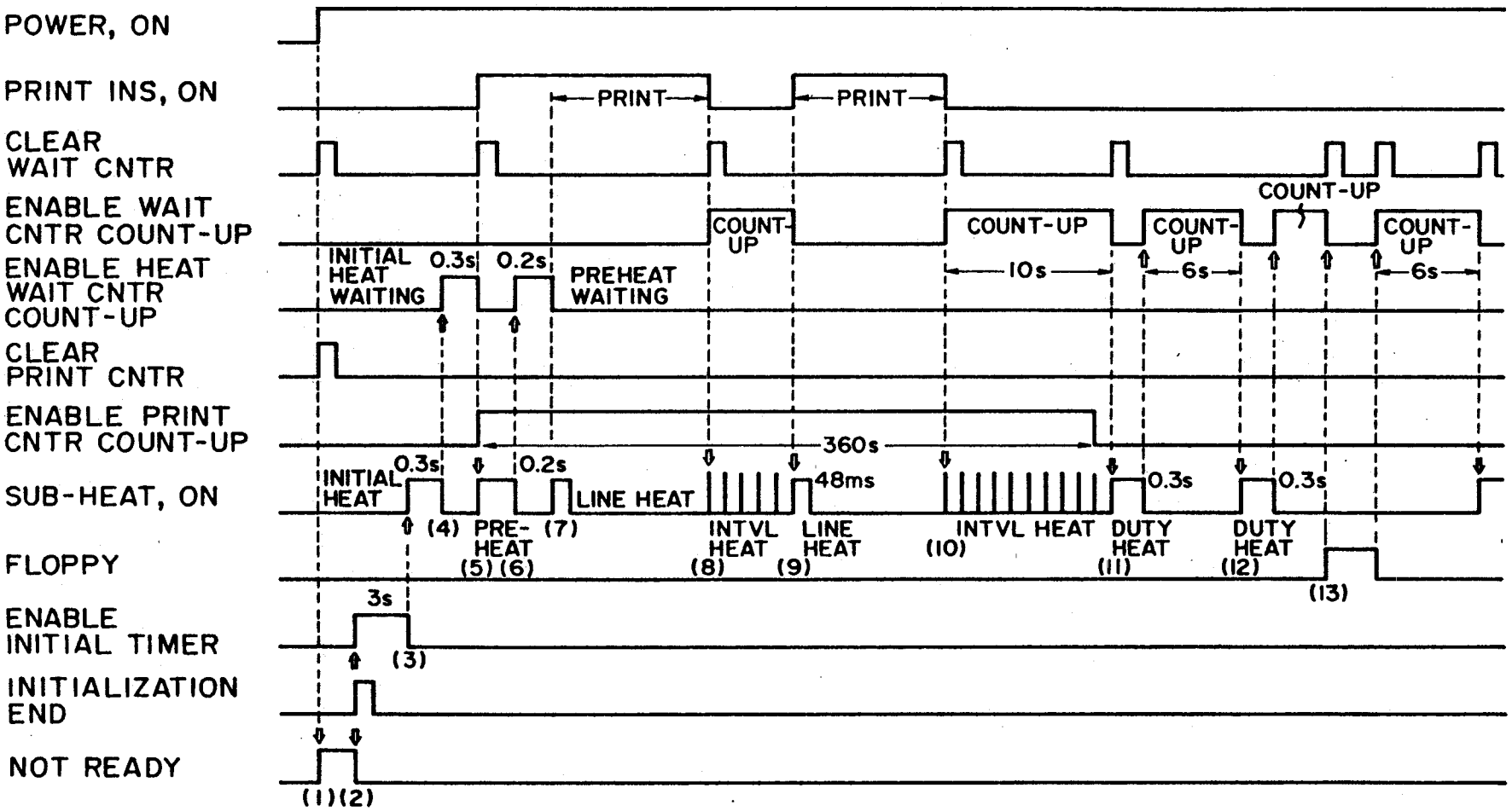
FIG. 12 is a sub-heat control timing chart by the key interval interruption process.

FIGS. 10A to 10D and 11 show flow charts for the operations executed upon key interval interruption on the basis of the key timer 1*a* in this embodiment. FIG. 12 shows a timing chart relating to this operation.

The description will be made as to the key interval interruption operation, referring to these Figures. The key interval interruption occurs every 8 msec, upon which the key interval interruption operation is started. Upon the start, at step S101, the key input by the operator is accepted. More particularly, the chattering removing operation for the key input and the storing of the input data in the key buffer to the RAM 106 are carried out. At step S103, the temperature detection and temperature correcting process described in detail in conjunction with FIG. 11, are carried out. At step S105, the discrimination is made as to whether the apparatus is at the initial stage occurring immediately after the actuation of the main switch. If so, the print counter (printing period counter) in the RAM 106 and the print wait counter (print waiting period counter) are cleared at step S107 (a point of time (1) in FIG. 12). At step S109 the discrimination is made as to whether or not the initializing operation for initializing the apparatus is to be carried out. If so, the waiting period for the initialization is counted at step S111 (2). If not, the discrimination is further made at step S113 as to whether or not the waiting counter for the initialization is counted up or not. If not counted up, the count-up is awaited.

When it is discriminated that the waiting period for the initialization (for various parts of the apparatus, such as RAM 106 or the like) ends, at step S113, the discrimination is made as to whether or not the timing for the start of the initial heating operation comes. If so, the sub-heat is actuated at step S117 (3), and thereafter, the initial heating period is counted at step S119 so as to effect the initial heating operation in accordance with the table shown in FIG. 13A. In other words, the temperature keeping heater 128 is energized for the sub-heat period corresponding to the rank determined at step S103. In FIG. 12, the initial heating period of 0.3 sec corresponds to rank 0, but it is only an example. This applies to the sub-heating period shown in FIG. 12. If the discrimination at step S115 is negative, the discrimination is made at S121 whether or not the initial heating ends. If not, the count-up of the initial heating period is awaited at step S119.

As will be understood from the foregoing, according to this embodiment, the start timing for the initial heating which is one of the sub-heat controls is controlled by the operation of the key interval interruption. The same applies to the start timing for the pre-heating, the line heating, the interval heating and the duty heating, and the start timing for another operation.

When the end of the initial heating is discriminated at step S121, the sub-heating operation is stopped at step S123. At step S124A, the discrimination is made as to whether or not the waiting period after the initial heating is to start. If so (4), the waiting period for the initial heating is started. The waiting period is provided for the purpose of dissipating the heat produced by the initial heating, and it is as long as 0.3 sec in this embodiment. If the discrimination at step S124A turned out negative, the further discrimination is made at step S124C as to whether or not the waiting period after the initial heating operation ends. If not, the count-up of the waiting period is awaited at step S124B.

When the end of the waiting period after the initial heating operation is discriminated at step S124C, the waiting counter is cleared at step S125, and the print counter is enabled to permit counting the printing period (5). When the print counter counts 360 sec, it retains the count thereafter, in other words, the print count-up enabling signal is rendered off. Then, at step S127, the discrimination is made as to whether or not the print counter of RAM 106 is 0.

If not, that is, if no line is printed, the further discrimination is made at step S128 as to whether or not the printing instructions are on state. If not, the operation returns to this process, and if so, the further discrimination is made at step S129 as to whether or not the timing for the start of the pre-heating comes. The printing instructions discriminated at step S128 include the instructions for driving the recording head 9 and the instructions for driving the various motors 31, 35 and 61. If it is already the timing for the start of the pre-heating operation, the sub-heating operation is actuated at step S131 to start the preheating operation (5), and the preheating period is counted at step S133. If it is not yet the timing for the start of the preheating operation as a result of the discrimination at step S129, the discrimination is further made at step S135 as to whether or not the preheating operation ends. If not, the count-up of the preheating period is awaited at step S133, and the operation returns to the main operation. The preheating period in this embodiment is 0.2 sec.

When the end of the preheating operation is discriminated at step S135, the sub-heating operation is stopped at step S137, and thereafter, the discrimination is made as to whether or not it is the timing for the start of the waiting period after the preheating operation. If so (6), the waiting period after the preheating operation is counted at step S141, and the operation returns to the main process. If the result of discrimination at step S139 is negative, the discrimination is made at step S143 as to whether or not the waiting period after the preheating operation ends. If not, the count-up of the waiting period after the preheating operation is awaited at step S141, and thereafter, the operation returns to the main process. The waiting period is also provided to dissipate the heat produced by the preheating operation.

When the waiting after the preheating operation is discriminated at step S143, the print ready is enabled at step S145, and the printing operation for one line is started in the recording apparatus. At the point of time of the end of the waiting period after the initial heating operation, the printing instructions are enabled, but the actual printing operation starts after the end of the waiting period after the preheating operation and upon the enabling of the print ready (point of time (7)). At step S147, the discrimination is made as to whether or not the printing instructions are produced. If not, the operation returns to the main process. If so, the discrimination is made at step S149 as to whether or not the interruption is at the timing for the start of the line heating operation. The printing instructions discriminated at step S147 are for driving the recording head 9, and therefore, do not include the instructions for various motors 31, 35 and 61.

If the outcome of the discrimination at the step S149 is affirmative, the sub-heating operation is started at step S151. At step S153, the line heating period is counted. When the printing period is counted up at step S155, the operation returns to the main process. If the outcome of the discrimination at step S149 is negative, the discrimination is made at step S157 on the basis of the count of the line heating operation as to whether or not the line heating operation ends. If not, the operations in the steps S153 and S155 are similarly executed, and therefore, the operation returns to the main process.

If the discrimination at step S157 indicates that the line heating operation has ended, the sub-heating operation is stopped at step S159. Then, the discrimination is made as to whether or not the printing operation ends, at step S161. If not, the operation returns to step S155. After the printing period is counted up, the operation returns to the main process. If the printing operation ends (8), the discrimination is made at step S162 as to whether or not the duty heating operation is carried out after the actuation of the main switch. If no duty heating operation has been carried out, the waiting counter of the RAM 106 is cleared at step S163, and the counting operation thereof is started at step S165. Then, the printing period is counted at step S167. Thus, the print counting operation for counting the printing period is continued at each of the key interval interruptions (every 8 msec) when the printing instructions are produced.

At step S169, the discrimination is made on the basis of the count of the waiting counter of the RAM 106 as to whether or not the print waiting period is not less than 10 sec. If not, the further discrimination is made as to whether or not the printing instructions are produced, at step S171. If not, the interval heating operation is started at step S173 (for example, the point of time (8) and the subsequent period). The interval heating operation is similar to the above-described initial heating operation, the pre-heating operation or the line heating operation, and therefore, the detailed descriptions are omitted. The interval heating operations include the discriminations as to the timing for the start and end of this operation, and the start and end of the sub-heating operation.

If the outcome of the discrimination at step S171 is on, that is, there are printing instructions for the second and/or the subsequent lines, the discrimination is made as to whether or not it is the timing for the start of the line heating, at step S175, similarly to the operation subsequent to the step S149. If so, the sub-heating operation is started at step S177 (9), and the line heating period is counted at step S179. The printing period is counted up at step S181, and the operation returns to the main process. If it is not the timing for the start of the line heating operation, and if the line heating operation is not ended, at step S183, the operations of the steps S179 and S181 are carried out, and the operation returns to the main process. As described in the foregoing, the interval heating operation is carried out during the waiting period, so that the second and the subsequent printing operations can be started only with the line heating operation without the preheating operation.

If the end of the line heat is discriminated at step S183, the sub-heating operation is stopped at step S185, and the discrimination is made at step S187 as to whether or not the printing operation for one line is finished. If not, the printing period is counted at step S181, and thereafter, the operation returns to the main process. If the outcome of the discrimination at step S187 is affirmative, the operation of step S162 is carried out. During the subsequent waiting period, the interval heating operation is carried out at step S173 (point of time (10)).

In FIG. 12, the time scale is changed before and after the point of time (10), for the sake of convenience. The printing period (approximately 1 sec) before the point of time (10) and the interval period (approximately 1 sec) subsequent thereto are substantially equal to the actual periods.

If the past duty heating operation is discriminated at step S162, that is, if the interval heating operation for 10 sec immediately after the end of the printing operation and the subsequent duty heating operations have been carried out in the past, the operation proceeds to step S191. First, the discrimination is made as to whether or not the waiting period is longer than 6 sec. If not, the operation returns to the main process. If so, the further discrimination is made at step S193 as to whether or not the printing instructions are produced. If so, the operation returns to step S175. If not, the duty heating operation subsequent to the step S195 described in the foregoing is carried out (for example, the point of time (12)).

Because of the processing operation subsequent to the step S162, the interval heating operation is carried out for 10 sec after the end of the printing operation, during the print waiting period. After 10 sec elapses, the duty heating operation is carried out. Subsequent thereto, the duty heating operations are carried out for every 6 sec.

The description will be made as to the reason why the duty heating operation is carried out after 10 sec elapses after completion of the printing operation. The interval heating operation is performed in order to prevent significant decreasing of the head temperature immediately after the completion of the printing operation. Therefore, the head temperature decreases if the interval heating operation is carried out for a long period of time then, the preheating operation is always required as the case may be. In view of this, if the waiting period is long, the duty heating operation supplying greater energy, rather than the interval heating operation, is carried out to prevent the decrease of the head temperature.

FIG. 11 shows details of the temperature detecting and temperature correcting operations at step S103. In this operation, the temperature is detected by the temperature sensor 124 at step S301. At step S303, the discrimination is made as to whether or not it is the timing for determining the rank which is one of the parameters for looking up the table shown in FIG. 13. In this embodiment, the temperature is detected at step S301 whenever the key interval interruption process is started at every 8 msec. Each time the data for 40 temperature detections are supplied, the rank is determined, so that the average of the temperature detected in the past 320 msec (40 interruptions) is obtained and is used as the base for the determination of the rank. If it is not the timing for the determination of the rank, the detected temperature is stored in the work area of the RAM 106, at step S305. Then, the operation ends.

Figure 14:
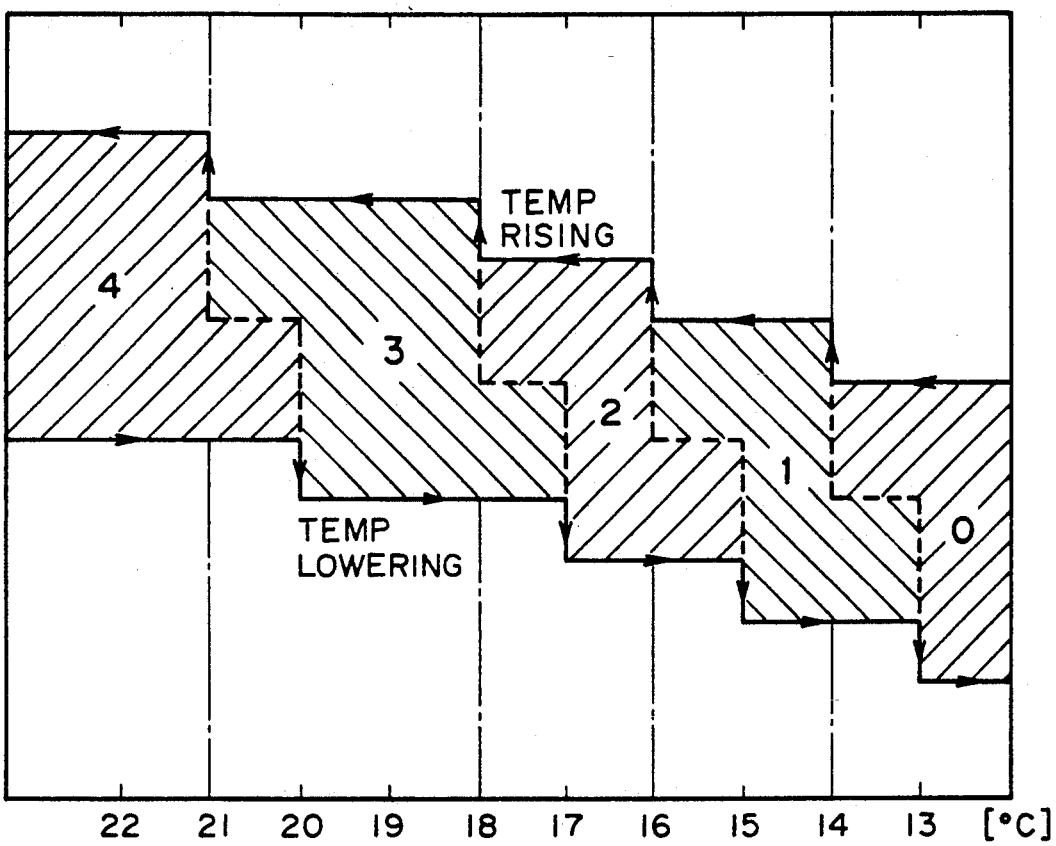
FIG. 14 illustrates a table used when a rank is determined on the basis of the detected temperature in the sub-heat control operation.

If the discrimination at step S303 is affirmative, the average temperature for the past 40 detections is stored in the register A in the work area of the RAM 106, at step S309. In this manner, the multiple temperatures detected in the last 320 msec are smoothed. At step S311, the temperature stored in the register A is compared with the temperature stored in the register B storing the immediately previous average temperature. If the temperature in the register A is lower, the decreasing temperature table of FIG. 14 is referred to in the determination of the rank. If the temperature in the register A is higher, the temperature increasing table is referred to in the determination of the rank. Thus the present smoothed temperature is also classified by comparing it to the past one, thereby classifying it in consideration of the temperature hysteresis.

At step S315, the content in the register A is shifted into the register B, at step S315. At step S317, the past average temperature of the past 40 detections is cleared, and the operation of this flow chart ends.

FIG. 15 is a flow chart showing the details of the operation for reading data from the disk at step S910 in FIG. 9. When this operation starts (point of time (13)), the file name is read at step S1501, and a message indicates that the reading operation is carried out, at step S1502. For the purpose of concentration on the disk operation, the interruption by the LCDC timer, the first timer and the second timer becomes unacceptable, at step S1503. In addition, at step S1504, the key interval interruption becomes unacceptable. At this time, the waiting counter is cleared. At step S1505, the directory of the document file name inputted is read out. At step S1506, the acceptance of the key interval interruption is enabled, and thereafter, at step S1507, the discrimination is made as to whether or not the reading of the document data is completed. On the basis of the sector information, are file allocation table (FAT) is referred to, and the discrimination is made as to whether or not this is the final sector of the document data. By doing so, if the document file has only the directory but does not have any data therein, the document data is not read out on the basis of the discrimination at step S1507. And the end of the data is discriminated. Then, the operation proceeds to step S1514.

If the discrimination at step S1507 turns out negative, the discrimination is made as to whether or not an error occurs at step S1508. If so, the error clearance operation is executed at step S1513. At step S1514, the end of the reading from the disk is displayed. This is the end of the operation.

If the result of the discrimination at step S1508 is negative, the FAT is searched at step S1509, so that the sector information subsequent to the current sector information is obtained. On the basis of the sector information, the key interval interruption acceptance is prohibited at step S1510. Thereafter, the document data of this sector is read out and stored in the FDD buffer of the RAM 106, at step S1511. Subsequently, the key interval interruption acceptance is enabled at step S1512. Then, the operations after the step S1507 are repeated until the sector information is for the end of the document file. The operation ends through step S1514.

In the foregoing embodiments, the temperature keeping heater is in the form of a heater different and separate from the ejection heaters, but the temperature keeping heater may be in the form of the same structure as the ejection heater, or may be the ejection heaters themselves to which the driving pulse not enough to eject the ink is supplied to produce heat for the purpose of the temperature maintenance.

In the foregoing embodiment, the recording apparatus is in the form of an electronic typewriter, but the present invention is applicable to any apparatus if it produces an interruption signal for accepting key input at the predetermined intervals as in a wordprocessor or the like.

In such cases, the sub-heating timer is used for dual or more purposes.

In the foregoing embodiments, the recovery operation such as preliminary ejection or sucking operation effected at proper times during the printing operation, is not particularly taken into account, because the preliminary ejection is the same as the usual printing operation since the ejection heater is driven and because although the ejection heaters are not driven during the sucking operation, the head temperature hardly decreases because of the relation among the capacity of the common liquid chamber, the thermal capacity of the heater board and the amount of the sucking ink. By effecting the preliminary ejection after the sucking recovery, the decrease of the head temperature can be suppressed.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond the nucleate boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording colors or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal produces thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

As will be understood from the foregoing description, according to the present invention, the duty heat drive is periodically effected when the predetermined period is exceeded during the print waiting period, and therefore, the necessity for the preheating operation is eliminated, or the preheating drive period can be reduced. As a result, the response to the printing instructions is improved, that is, the time between the production of the printing instruction to the start of the printing is decreased.

According to the present invention, the counting operations by the print counter and the waiting counter for controlling the heating element driving period in the sub-heating control and the timing for various control operations, can be controlled on the basis of the key interval interruption. As a result, the structure of the timer for the interruption is simplified.

Furthermore, according to the present invention, the temperature detection process, the temperature smoothing process for the detected temperature and the class or rank determination process for the smoothed temperature can be carried out on the basis of the key interval interruption for accepting the key input. As a result, the timer structure is further simplified.

Additionally, according to the present invention, a common power source is used for the carriage drive and the sub-heating drive. The tables for the sub-heating drives are provided for the respective power source voltages selectively used in the carriage movement mode. Accordingly, the structure of the power source is simplified while the sub-heating control is effectively carried out.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording apparatus using a recording head for ejecting ink, the apparatus comprising:

temperature detecting means for detecting an ambient temperature of the recording head;

a heating element in the recording head for controlling a temperature of the ink by heating the ink in the recording head;

wait counter means for counting a print waiting period of the recording head;

table means for determining driving information for said heating element in accordance with an output of said temperature detecting means; and control means, responsive to said table means and said wait counter means, for controlling said heating element, said control means controlling an interval heating operation effected in the print waiting period after an end of a first printing operation and before a start of another printing operation within a predetermined period after the end of the first printing operation, and controlling a duty heating operation effected periodically when the predetermined period is exceeded.

2. An apparatus according to claim 1, wherein said control means further controls an initial heating operation effected upon an actuation of a main switch of said apparatus, a preheating operation effected at an initial start of the printing operation within a predetermined period, and a line heating operation effected at a start of each line printing operation.

3. An apparatus according to claim 2, wherein the preheating operation is effected only immediately before the start of the printing operation after the actuation of the main switch.

4. An apparatus according to claim 2 or 3, wherein the duty heating operation is not effected between the initial heating operation and the preheating operation effected immediately before the start of the printing operation after the actuation of the main switch.

5. An apparatus according to claim 1, wherein an energy per unit time of the interval heating operation is smaller than an energy per unit time of the duty heating operation.

6. An apparatus according to claim 5, wherein a time period in which said heating element is energized by the interval heating operation is shorter than a time period in which said heating element is energized by the duty heating operation.

7. An apparatus according to claim 1, further comprising key input means for inputting information to be recorded by said recording apparatus.

8. An apparatus according to claim 1, wherein the recording head is provided with thermal energy generating means for causing a state change in the ink by heat to product an ejected ink droplet.

9. An ink jet recording apparatus using a recording head for ejecting ink, the apparatus comprising:

temperature detecting means for detecting an ambient temperature of the recording head;

a heating element in the recording head for controlling a temperature of the ink by heating the ink in the recording head;

print counter means for counting a printing period of the recording head;

wait counter means for counting a print waiting period of the recording head;

table means for determining driving information for said heating element in accordance with an output of said temperature detecting means and an output of said print counter means or an output of said wait counter means;

first control means, responsive to said table means, for controlling said heating element;

interruption signal generating means for generating periodic key interval interruption signals to permit key input to the recording apparatus; and second control means, responsive to the periodic key interval interruption signals, for effecting a counting operation of said print counter means or said wait counter means.

10. An apparatus according to claim 9, wherein said first control means controls an interval heating operation, effected in the print waiting period after an end of a first printing operation and before a start of another printing operation within a predetermined period after the end of the first printing operation, and a duty heating operation, effected periodically when the predetermined period is exceeded, in accordance with said wait counter means.

11. An apparatus according to claim 10, wherein said first control means controls an initial heating operation effected upon actuation of a main switch of said apparatus, a preheating operation effected an initial start of the printing operation within a predetermined period, and a line heating operation effected at a start of each line printing operation.

12. An apparatus according to claim 11, wherein the preheating operation is effected only immediately before the start of the printing operation after the actuation of the main switch.

13. An apparatus according to claim 11, wherein the duty heating operation is not effected between the initial heating operation and the preheating operation effected immediately before the start of the printing operation after the actuation of the main switch.

14. An apparatus according to claim 10, wherein an energy per unit time of the interval heating operation is smaller than an energy per unit time of the duty heating operation.

15. An apparatus according to claim 14, wherein a time period in which said heating element is energized by the interval heating operation is shorter than a time period in which said heating element is energized by the duty heating operation.

16. An apparatus according to claim 9, wherein the recording head is provided with thermal energy generating means for causing a state change in the ink by heat to produce an ejected ink droplet.

17. An ink jet recording apparatus using a recording head for ejecting ink, the apparatus comprising:

temperature detecting means for detecting an ambient temperature of the recording head;

a heating element in the recording head for controlling a temperature of the ink by heating the ink in the recording head;

print counter means for counting a printing period of the recording head;

wait counter means for counting a print waiting period of the recording head;

table means for determining driving information for said heating element in accordance with an output of said temperature detecting means and an output of said print counter or an output of said wait counter means;

first control means, responsive to said table means for controlling said heating element;

key input means for inputting information to be recorded by said recording apparatus;

interruption signal generating means for generating periodic key interval interruption signals for accepting input by said key input means; and second control means, responsive to the periodic key interval interruption signals, for effecting a counting operation of said print counter means or said wait counter means.

18. An apparatus according to claim 17, further comprising processing means for processing document information inputted by said key input means.

19. An apparatus according to claim 18, further comprising display means for displaying the document information processed by said processing means.

20. An apparatus according to claim 17, wherein said first control means controls an interval heating operation effected, in the print waiting period after an end of a first printing operation and before a start of another printing operation within a predetermined period after the end of the first printing operation, and a duty heating operation, effected periodically when the predetermined period is exceeded, in accordance with said wait counter means.

21. An apparatus according to claim 20, wherein said first control means controls an initial heating operation effected upon actuation of a main switch of said apparatus, a preheating operation effected at an initial start of the printing operation within a predetermined period, and a line heating operation effected at a start of each line printing operation.

22. An apparatus according to claim 21, wherein the preheating operation is effected only immediately before the start of the printing operation after the actuation of the main switch.

23. An apparatus according to claim 21, wherein the duty heating operation is not effected between the initial heating operation and the preheating operation effected immediately before the start of the printing operation after the actuation of the main switch.

24. An apparatus according to claim 20, wherein an energy per unit time of the interval heating operation is smaller than an energy per unit time of the duty heating operation.

25. An apparatus according to claim 24, wherein a time period in which said heating element is energized by the interval heating operation is shorter than a time period in which said heating element is energized by the duty heating operation.

26. An apparatus according to claim 24, wherein the recording head is provided with thermal energy generating means for causing a state change in the ink by heat to produce an ejected ink droplet.

27. An ink jet recording apparatus using a recording head for ejecting ink, the apparatus comprising:

temperature detecting means for detecting an ambient temperature of the recording head a plurality of times;

smoothing means for smoothing the plural temperatures detected by said temperature detecting means;

temperature level classifying means for classifying an output of said smoothing means in consideration of a temperature hysteresis;

a heating element in the recording head for controlling a temperature of the ink by heating the ink in the recording head;

table means for determining driving information for said heating element in accordance with an output of said classifying means;

first control means for controlling said heating element in accordance with an output of said table means;

interruption signal generating means for generating periodic key interval interruption signals to permit key input to the recording apparatus; and second control means, responsive to the periodic key interval interruption signals for determining operations of said temperature detecting means, said smoothing means and said classifying means.

28. An apparatus according to claim 27, further comprising wait counter means for counting a print waiting period of the recording head.

29. An apparatus according to claim 28, wherein said table means is further responsive to an output of said wait counter means.

30. An apparatus according to claim 28, wherein said first control means further controls an operational timing of said wait counter means in accordance with the periodic key interval interruption signals.

31. An apparatus according to claim 29, wherein said first control means controls an interval heating operation, effected in the print waiting period after an end of a first printing operation and before a start of another printing operation within a predetermined period after the end of the printing operation, and a duty heating operation, effected periodically when the predetermined period is exceeded, in accordance with said wait counter means.

32. An apparatus according to claim 31, wherein said first control means further controls an initial heating operation effected upon actuation of a main switch of said apparatus, a preheating operation effected at an initial start of the printing operation within a predetermined period, and a line heating operation effected at a start of each line printing operation.

33. An apparatus according to claim 32, wherein the preheating operation is effected only immediately before the start of the printing operation after the actuation of the main switch.

34. An apparatus according to claim 32, wherein the duty heating operation is not effected between the initial heating operation and the preheating operation effected immediately before the start of the printing operation after the actuation of the main switch.

35. An apparatus according to claim 31, wherein an energy per unit time of the interval heating operation is smaller than an energy per unit time of the duty heating operation.

36. An apparatus according to claim 35, wherein a time period in which said heating element is energized by the interval heating operation is shorter than a time period in which said heating element is energized by the duty heating operation.

37. An apparatus according to claim 29, wherein the recording head is provided with thermal energy generating means for causing a state change in the ink by heat to produce an ejected ink droplet.

38. An ink jet recording apparatus using a recording head for ejecting ink, the apparatus comprising:

moving means for moving the recording head during a printing operation;

power supply means for supplying electric power to said moving means in accordance with a movement speed of said moving means;

temperature detecting means for detecting an ambient temperature of the recording head;

a heating element in the recording head for controlling a temperature of the ink by heating the ink in the recording head;

energizing means for energizing said heating element with the electric power from said power supply means;

wait counter means for counting a print waiting period of the recording head;

table means for determining driving information for said heating element in accordance with an output of said temperature detecting means, an output of said wait counter and an output of said power supply means; and control means for controlling said heating element by said energizing means in accordance with an output of said table means.

39. An apparatus according to claim 38, wherein said moving means includes a carriage for mounting thereon the recording head.

40. An apparatus according to claim 39, wherein said moving means includes a carriage motor for moving the carriage.

41. An apparatus according to claim 38, wherein a movement speed of said moving means is higher in a draft mode operation than in a fine mode operation.

42. An apparatus according to claim 41, wherein said power supply means supplies to said moving means a voltage which is higher in the draft mode than in the fine mode.

43. An apparatus according to claim 38, wherein said control means controls an interval heating operation effected in the print waiting period after an end of a first printing operation and before a start of another printing operation within a predetermined period after the end of the first printing operation and a duty heating operation effected periodically when the predetermined period is exceeded.

44. An apparatus according to claim 43, wherein said control means further controls an initial heating operation effected upon actuation of a main switch of said apparatus, a preheating operation effected at an initial start of the printing operation within a predetermined period, and a line heating operation effected at a start of each line printing operation.

45. An apparatus according to claim 44, wherein the preheating operation is effected only immediately before the start of the printing operation after the actuation of the main switch.

46. An apparatus according to claim 44, wherein the duty heating operation is not effected between the initial heating operation and the preheating operation effected immediately before the start of the printing operation after the actuation of the main switch.

47. An apparatus according to claim 43, wherein an energy per unit time of the interval heating operation is smaller than an energy per unit time of the duty heating operation.

48. An apparatus according to claim 47, wherein a time period in which said heating element is energized by the interval heating operation is shorter than a time period in which said heating element is energized by the duty heating operation.

49. An apparatus according to claim 38, wherein said recording head is provided with thermal energy generating means for causing a state change in the ink by heat to produce an ejected ink droplet.

50. A ink jet recording method using a recording head ejecting ink, the method comprising the steps of:

detecting an ambient temperature of the recording head;

a first heating step of heating the recording head at first intervals with energy in accordance with the temperature detected after each recording operation of the recording head;

a second heating step of heating the recording head at second intervals in accordance with the detected temperature after a predetermined period elapses after an end of the recording operation, with energy larger than the energy in said first heating step; and a recording step of driving the recording head after said first or second heating step.

51. A method according to claim 50, wherein the second intervals are longer than the first intervals.

52. An method according to claim 50, wherein the recording head is provided with thermal energy generating means for causing a state change in the ink by heat to produce an ejected ink droplet.

53. An ink jet recording apparatus using a recording head for ejecting ink, the apparatus comprising:

temperature detecting means for detecting an ambient temperature of the recording head;

a heating element in the recording head for controlling temperature of the ink by heating the ink in the recording head;

wait counter means for counting a print waiting period of the recording head; and control means, responsive to an output of said temperature detecting means and said wait counter means, for controlling said heating element, said control means controlling an interval heating operation effected in the print waiting period after an end of a first printing operation and before a start of another printing operation within a predetermined period after the end of the first printing operation, and controlling a duty heating operation effected periodically when the predetermined period is exceeded.

54. An apparatus according to claim 53, wherein said control means further controls an initial heating operation effected upon actuation of a main switch of said apparatus, a preheating operation effected at an initial start of the printing operation within a predetermined period, and a line heating operation effected at a start of each line printing operation.

55. An apparatus according to claim 54, wherein the preheating operation is effected only immediately before the start of the printing operation, after the actuation of the main switch.

56. An apparatus according to claim 54 or 55, wherein the duty heating operation is not effected between the initial heating operation and the preheating operation effected immediately before the start of the printing operation after the actuation of the main switch.

57. An apparatus according to claim 53, wherein an energy per unit time of the interval heating operation is smaller than an energy per unit time of the duty heating operation.

58. An apparatus according to claim 57, wherein a time period in which said heating element is energized by the interval heating operation is shorter than a time period in which said heating element is energized by the duty heating operation.

59. An apparatus according to claim 53, further comprising key input means for inputting information to be recorded by said recording apparatus.

60. An apparatus according to claim 53, wherein the recording head is provided with thermal energy generating means for causing a state change in the ink by heat to produce an ejected ink droplet.

* * * * *

UNITED STATES PATENT AND TRADEMARK OFFICE

CERTIFICATE OF CORRECTION

PATENT NO. : 5,307,093

DATED : April 26, 1994

INVENTOR(S) : NAOHISA SUZUKI ET AL.

It is certified that error appears in the above-identified patent and that said Letters Patent is hereby corrected as shown below:

ON TITLE PAGE

AT [54] TITLE
"HEAT" should read --HEAD--.

IN THE DRAWINGS

Sheet 6 of 23, in FIG. 5A,
"ETECTION" should read --EJECTION--.

Sheet 23 of 23, in FIG. 15,
"MASSAGE" should read --MESSAGE--.

COLUMN 1

Line 4, "HEAT" should read --HEAD--.
Line 32, "container," should read --container--.

COLUMN 2

Line 38, "timers" should read --timers,--.

COLUMN 5

Line 46, "comprise" should read --comprises--.

COLUMN 7

Line 31, "a" should read --an--.

UNITED STATES PATENT AND TRADEMARK OFFICE

CERTIFICATE OF CORRECTION

PATENT NO. : 5,307,093

DATED : April 26, 1994

INVENTOR(S) : NAOHISA SUZUKI ET AL.

It is certified that error appears in the above-identified patent and that said Letters Patent is hereby corrected as shown below:

COLUMN 9

Line 2, "support port 120," should read --supply port 1200,--.
Line 8, "with" should read --with a--.

COLUMN 10

Line 20, "and," should read --are--.

COLUMN 16

Line 56, "are" should read --the--.

COLUMN 20

Line 54, "product" should read --produce--.

UNITED STATES PATENT AND TRADEMARK OFFICE

CERTIFICATE OF CORRECTION

PATENT NO. : 5,307,093

DATED : April 26, 1994

INVENTOR(S) : NAOHISA SUZUKI ET AL.

It is certified that error appears in the above-identified patent and that said Letters Patent is hereby corrected as shown below:

COLUMN 21

Line 24, "effected" should read --effected at--.

Signed and Sealed this

Twenty-fourth Day of January, 1995

Attest:

Bruce Lehman

BRUCE LEHMAN

Attesting Officer

Commissioner of Patents and Trademarks